US011415356B2

(12) United States Patent
Kim et al.

(10) Patent No.: US 11,415,356 B2
(45) Date of Patent: Aug. 16, 2022

(54) REFRIGERATOR

(71) Applicant: LG Electronics Inc., Seoul (KR)

(72) Inventors: Jiwon Kim, Seoul (KR); Wookyung Baik, Seoul (KR)

(73) Assignee: LG Electronics Inc., Seoul (KR)

( * ) Notice: Subject to any disclaimer, the term of this patent is extended or adjusted under 35 U.S.C. 154(b) by 590 days.

(21) Appl. No.: 16/054,308

(22) Filed: Aug. 3, 2018

(65) Prior Publication Data

US 2019/0041119 A1 Feb. 7, 2019

(30) Foreign Application Priority Data

Aug. 3, 2017 (KR) ..... 10-2017-0098454

(51) Int. Cl.

| | |
|---|---|
| ***F25D 17/04*** | (2006.01) |
| ***F25D 17/08*** | (2006.01) |
| ***F25D 17/06*** | (2006.01) |
| ***F25C 5/20*** | (2018.01) |
| ***F25B 39/02*** | (2006.01) |

(52) U.S. Cl.

CPC ..... *F25D 17/045* (2013.01); *F25B 39/024* (2013.01); *F25C 5/22* (2018.01); *F25D 17/062* (2013.01); *F25D 17/065* (2013.01); *F25D 17/067* (2013.01); *F25D 17/08* (2013.01);

(Continued)

(58) Field of Classification Search

CPC .... F25D 17/045; F25D 17/067; F25D 17/065; F25D 17/062; F25D 17/08; F25D 2317/067; F25D 2317/063; F25D 2317/0665; F25D 23/066; F25D 19/00; F25D 23/006; F25D 23/067;

(Continued)

(56) References Cited

U.S. PATENT DOCUMENTS 2,292,032 A * 8/1942 Atchison ..... F25D 17/04 62/283
2,775,873 A * 1/1957 Jones ..... F25D 17/08 62/419

(Continued)

FOREIGN PATENT DOCUMENTS

JP 2010169302 8/2010
KR 1020060132770 12/2006

(Continued)

OTHER PUBLICATIONS

Office Action in Korean Appln. No. 10-2017-0098454, dated Jun. 7, 2021, 12 pages (with English translation).

*Primary Examiner* — Eric S Ruppert
*Assistant Examiner* — Kirstin U Oswald
(74) *Attorney, Agent, or Firm* — Fish & Richardson P.C.

(57) ABSTRACT

A refrigerator includes a cabinet, an evaporator, an evaporator cover module, and a cold air supply module configured to communicate with the evaporator cover module. The evaporator cover module includes a rear plate that has a planar shape and that defines the surface of the storage space, a first insulation member located at a rear surface of the rear plate, and a second insulation member spaced apart from the first insulation member and located at a front surface of the inner case. The first insulation member and the second insulation member define a heat-exchange space configured to accommodate the evaporator between the first insulation member and the second insulation member.

20 Claims, 25 Drawing Sheets

(52) U.S. Cl.
CPC .. *F25D 2317/063* (2013.01); *F25D 2317/067* (2013.01); *F25D 2317/0665* (2013.01)

(58) Field of Classification Search
CPC ..... F25D 2323/122; F25C 5/22; F25C 1/25; F25B 39/024
USPC ..... 62/407
See application file for complete search history.

(56) References Cited

U.S. PATENT DOCUMENTS 2,863,300 A * 12/1958 Murphy ..... F25D 17/045 62/155
2,866,323 A * 12/1958 Candor ..... F25D 17/065 62/278
3,081,608 A * 3/1963 Buchanan ..... F25D 17/062 62/DIG. 13
3,084,519 A * 4/1963 Hanson ..... F25D 17/062 62/289
3,111,818 A * 11/1963 Dolan ..... F25D 17/065 62/526
3,174,642 A * 3/1965 Loewenthal ..... F25D 23/064 220/902
3,196,632 A * 7/1965 Buffington ..... F25D 21/14 312/351
3,590,594 A * 7/1971 Arend ..... F25D 17/065 62/97
5,048,306 A * 9/1991 Wakatsuki ..... F25D 17/08 62/419
5,501,084 A 3/1996 Chang et al.
5,819,552 A * 10/1998 Lee ..... F25D 17/065 62/407
6,434,954 B1 * 8/2002 Hess ..... F25D 17/045 62/448
6,776,003 B1 * 8/2004 Bollen ..... F25D 17/08 62/434
7,204,095 B2 * 4/2007 Jeong ..... F25D 17/065 62/186
7,891,205 B2 * 2/2011 Cushman ..... F25D 17/065 62/186
9,341,402 B1 * 5/2016 Loudermilk ..... F25C 5/182
9,557,091 B1 * 1/2017 Zardo ..... F25D 23/061
10,302,345 B2 5/2019 Lee et al.
10,408,527 B2 9/2019 Cho et al.
2008/0034780 A1 * 2/2008 Lim ..... F25C 1/04 62/353
2009/0038336 A1 * 2/2009 Gorz ..... F25D 17/062 62/419
2009/0126390 A1 * 5/2009 Park ..... F25D 23/126 220/565
2009/0165486 A1 * 7/2009 Harlen ..... F25D 21/08 62/276
2010/0050681 A1 * 3/2010 Ryu ..... F25D 23/12 62/344
2010/0295435 A1 * 11/2010 Kendall ..... F25D 17/062 312/401
2011/0197619 A1 * 8/2011 Kim ..... F25C 1/24 62/344
2012/0047934 A1 * 3/2012 Park ..... F25D 25/024 62/264
2012/0181911 A1 * 7/2012 Kim ..... F25D 17/042 312/405
2012/0285193 A1 * 11/2012 Choi ..... F25D 23/062 62/419
2014/0290302 A1 * 10/2014 Shin ..... F25D 11/022 62/419
2015/0153097 A1 * 6/2015 Koo ..... F25D 23/006 62/428
2016/0054047 A1 * 2/2016 Lim ..... F25D 17/065 62/407
2016/0097578 A1 * 4/2016 Hyun ..... F25D 17/062 62/96
2017/0038129 A1 2/2017 Chae et al.
2017/0059224 A1 * 3/2017 Bae ..... F25D 17/062
2017/0284724 A1 * 10/2017 Lee ..... F25D 17/065

FOREIGN PATENT DOCUMENTS

KR 100725494 6/2007
KR 1020150118482 10/2015
KR 1020160027877 3/2016
KR 1020170065948 6/2017

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2017-0098454, filed on Aug. 3, 2017, which is hereby incorporated by reference in its entirety.

BACKGROUND

The present disclosure relates to a refrigerator.

In general, refrigerators are home appliances for storing foods at a low temperature in a storage space that is covered by a door. For this, refrigerators cool the inside of the storage space by using cool air generated by being heat-exchanged with a refrigerant circulated through a refrigeration cycle to store foods in an optimum state.

In recent years, refrigerators have become increasingly multi-functional with changes of dietary lives and gentrification of products, and refrigerators having various structures and convenience devices for convenience of users and for efficient use of internal spaces have been released.

Also, in recent years, a built-in type refrigerator has been developed, in which the same panel as furniture or a wall surface is attached to a refrigerator door so as to have a sense of unity with the furniture or the wall surface within a space in which the refrigerator is disposed.

A built-in type refrigerator, particularly, a refrigerator in which cold air is supplied to a plurality of spaces by using one evaporator is disclosed in Korean Patent Publication No. 10-2006-0132770.

However, in the refrigerator having the above-described structure, in the case of a refrigerating compartment having a relatively large volume among a plurality of spaces, it is difficult to effectively perform cooling, and also, it is difficult to individually control a temperature of each space. Also, when the plurality of spaces are cooled through a single refrigeration cycle, an amount of refrigerant within the single refrigeration cycle increases to lead to limitations such as oversizing of the cycle and nonconformity of safety and environmental regulations.

When a plurality of fin-type evaporators are disposed, the storage space within the refrigerator may be reduced by the plurality of evaporators, and also, the storage space within the refrigerator may be further reduced due to placement of an independent fan, a motor, and the like.

Also, in the built-in type refrigerator, when the insulation thickness is sufficient, a loss of cold air in the storage space within the refrigerator may occur. When it is intended to secure the space within the refrigerator, the insulation thickness may be thin to cause a limitation in insulation.

Also, when a water path disposed to supply water to the inside of the refrigerator passes between an outer case and an inner case, insulation performance at the corresponding portion may become weak, and the workability of assembling and arranging the water pass is deteriorated.

SUMMARY

Embodiments provide a refrigerator that is improved in insulation performance.

Embodiments also provide a refrigerator which is excellent in assembling workability and improved in productivity.

Embodiments also provide a refrigerator that is capable of minimizing a loss in storage capacity of a space within the refrigerator.

In one embodiment, a refrigerator includes: a cabinet including an outer case defining an outer appearance thereof and an inner case defining a storage space inside the outer case; a roll bond evaporator provided in the storage space; an evaporator cover module mounted on the inner case to cover the evaporator and defining one surface of the storage space; and a cold air supply module communicating with the evaporator cover module to supply cold air within the evaporator cover module to the storage space by an operation of a blower fan, wherein the evaporator cover module includes: a rear plate having a plate shape and defining one surface of the storage space; a first insulation member disposed on a rear surface of the rear plate; a second insulation member spaced apart from the first insulation member and disposed on a front surface of the inner case; and a heat-exchange space defined by a space between the first insulation member and the second insulation member to accommodate the roll bond evaporator.

The roll bond evaporator may be fixed and mounted in a state of being spaced apart from one surface of the inner case, which corresponds to a rear surface of the storage space.

The roll bond evaporator may have a size corresponding to the heat-exchange space and be disposed to be spaced apart from the first insulation member and the second insulation member.

The inner case may be made of a metal material and provided by coupling a plurality of plates defining at least one surface of the storage space to each other.

An evaporator fixing member passing through the inner case and the second insulation member to support and mount the roll bond evaporator thereon may be disposed on a rear surface of the inner case, and the evaporator fixing member may fix the evaporator so that the roll bond evaporator is disposed at a position that is spaced apart from the first insulation member and the second insulation member.

The evaporator fixing member may include: a support plate closely attached to the rear surface of the inner case; and a boss part passing through the inner case and the second insulation member from the support plate to extend so as to come into contact with the evaporator, wherein a coupling member passing through the evaporator may be coupled to the boss part.

A radiation layer made of a metal material to radiate the cold air of the evaporator may be disposed on each of surfaces of the first insulation member and the second insulation member, which define the inside of the heat-exchange space.

A pair of side ducts defining both ends of the heat-exchange space and made of an insulation member may be disposed on both left and right ends of the evaporator.

The side ducts may be disposed on both sides of a rear surface of the rear plate, and all of the first insulation member, the second insulation member, and the evaporator may be disposed in a region between the side ducts.

An adhesion member having elasticity may be disposed on each of the side ducts, and the adhesion member may be attached to a front surface of the inner case to seal the heat-exchange space between the side ducts.

A tube guide part recessed to accommodate a water supply tube for supplying water and extending in a longitudinal direction of the side duct may be disposed in each of the side ducts.

The tube guide part may be opened at upper and lower ends of the side duct so that the water supply tube is introduced into the storage space through the tube guide part.

The filter may be disposed on an outer top surface of the cabinet, and the water supply tube connected to the filter may pass through the cabinet and is introduced into the tube guide part.

Each of the side ducts may include: a duct support part defining the heat-exchange space at a side of the evaporator; and a duct front part extending from the duct support part to define the recessed tube guide part, wherein the duct support part may have a thickness greater than that of the duct front part to prevent the water supply tube from being directly cooled by the evaporator.

A recess part in which a water tank connected to the water supply tube is accommodated may be defined in a bottom surface of the storage space.

The recess part may be disposed at the front of a suction hole that is opened in a lower end of the evaporator cover module and cooled by the cold air suctioned to the suction hole.

The water supply tube may be branched by valves inside the recess part, the water supply tube may include: a dispenser tube connected to a dispenser disposed inside the storage space; and an ice maker tube connected to an ice maker disposed inside a freezing compartment that is independent from the storage space, wherein all of the dispenser tube, the ice maker tube, the water tank, and the valves may be connected to each other inside the recess part.

A dispenser tube guide pipe guiding the dispenser tube from a side surface of the recess part to the dispenser and an ice maker tube guide pipe guiding the ice maker tube from the side surface of the recess part to the ice maker may be disposed on a side surface of the inner case, and the dispenser tube guide pipe and the ice maker tube guide pipe may be buried in an insulation member that is filled between the inner case and the outer case.

The cabinet may include a refrigerating compartment and a freezing compartment, the roll bond evaporator may be disposed in the refrigerating compartment, and a fin-type evaporator may be disposed in the freezing compartment.

The roll bond evaporator and the fin-type evaporator may be respectively connected to compressors to constitute independent refrigeration cycles.

The details of one or more embodiments are set forth in the accompanying drawings and the description below. Other features will be apparent from the description and drawings, and from the claims.

DETAILED DESCRIPTION

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
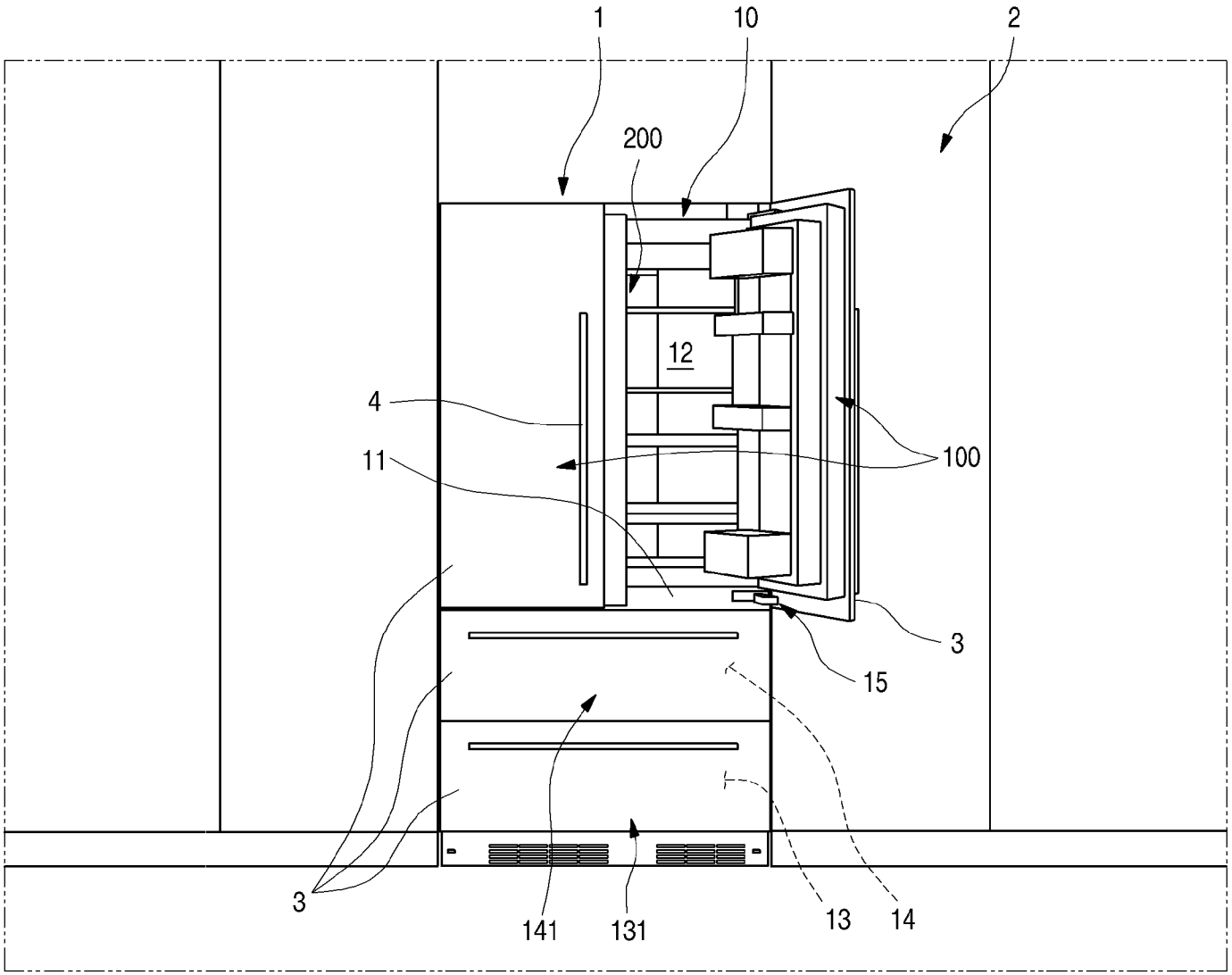
FIG. 1 is a view illustrating an installation state of a refrigerator according to an embodiment.
Figure 2:
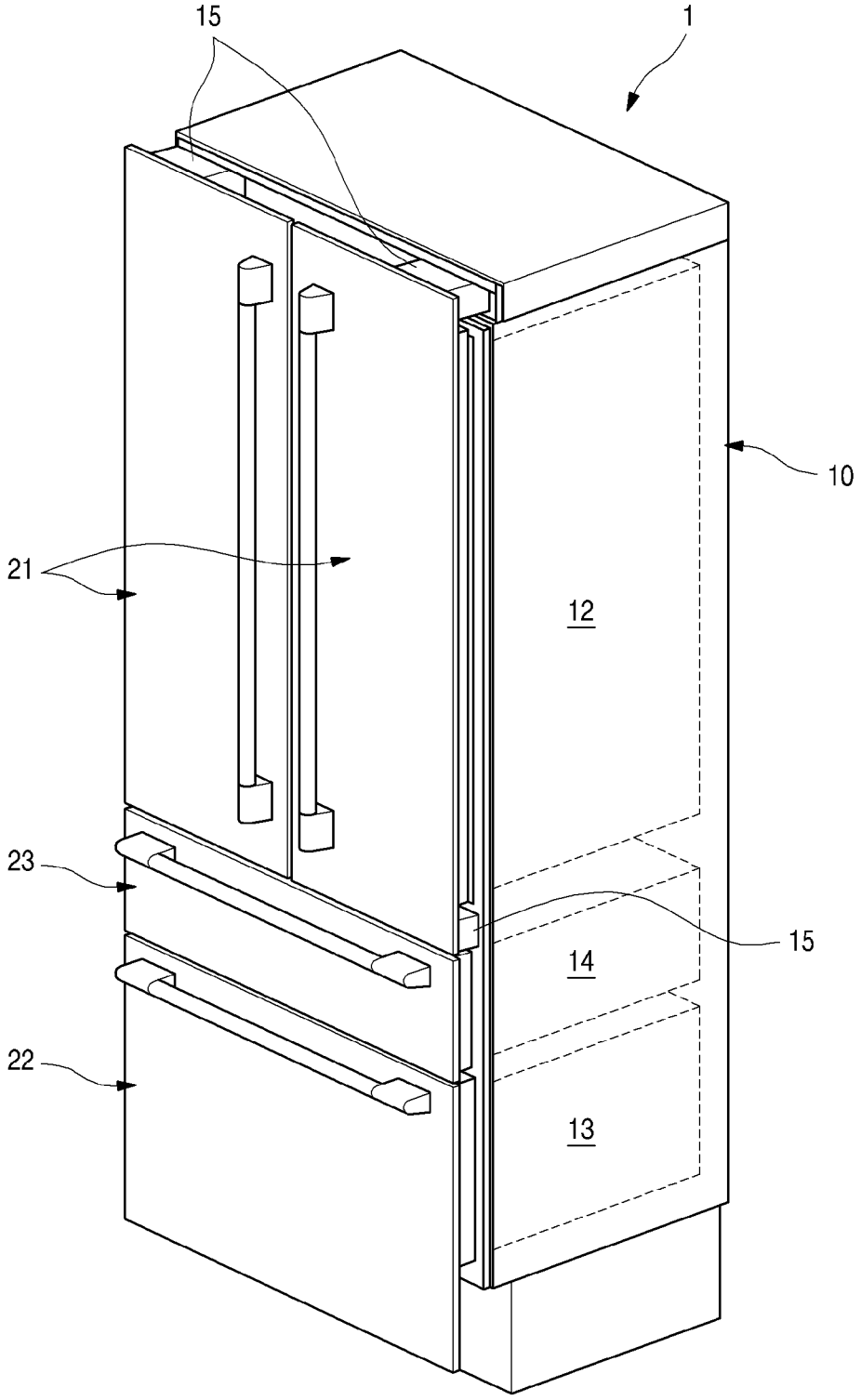
FIG. 2 is a perspective view of the refrigerator.
Figure 3:
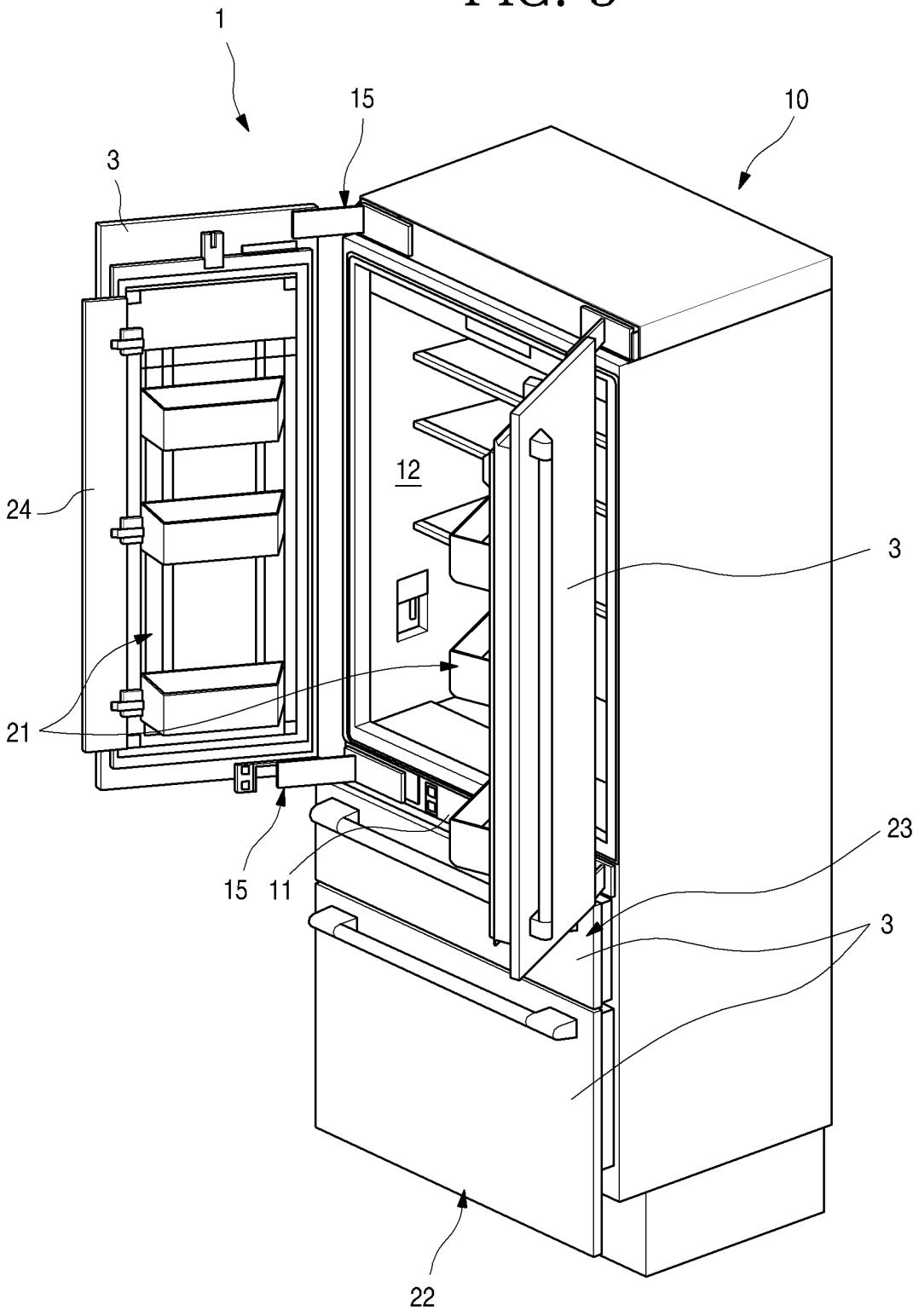
FIG. 3 is a perspective view illustrating a state in which a portion of doors of the refrigerator is opened.

FIG. 1 is a view illustrating an installation state of a refrigerator according to an embodiment. Also, FIG. 2 is a perspective view of the refrigerator. Also, FIG. 3 is a perspective view illustrating a state in which a portion of doors of the refrigerator is opened.

A refrigerator 1 according to an embodiment may be a built-in type refrigerator that is mounted with a sense of unity with furniture installed in an indoor space or between walls in which an exterior is provided.

As illustrated in FIG. 1, the refrigerator 1 may have a sense of unity with furniture 2 in the state of being installed. Thus, a front outer appearance of the refrigerator 1 may be formed by a panel 3 made of the same material or the same texture as the furniture. In the state in which the refrigerator 1 is installed, the panels 3 may be disposed to on the same plane as front surface of furniture 2 around the refrigerator 1.

The refrigerator 1 may have an outer appearance that is defined by a cabinet 11 defining a storage space and doors 21, 22, and 23 covering an opened front surface of the cabinet 11. The doors 21, 22, and 23 may be in a state in which the panel 3 is mounted. The panel 3 and the doors 21, 22, and 23 may be provided as separate parts.

The storage space may be divided into a plurality of spaces within the cabinet 11. As illustrated in the drawings, the storage space may include an upper refrigerating compartment 12, a lower freezing compartment 13, and a switching compartment between the refrigerating compartment 12 and the freezing compartment 13. The refrigerating compartment may be maintained at a temperature of a refrigerating region, and the freezing compartment 13 may be maintained at a below zero temperature for storing foods in a frozen state. Also, the switching compartment 14 may be switched into the refrigerating compartment 12 and the freezing compartment 13 according to a selective flow of cold air. As necessary, the switching compartment 14 may be maintained at a set temperature.

Of course, the present invention is not limited to the configuration of the storage space according to this embodiment, but may be applied to a refrigerator having various storage space configurations divided into at least two storage spaces.

The doors may include a refrigerating compartment door 21, a freezing compartment door 22, and a switching compartment door 23, which respectively independently open the storage spaces. The configurations of the doors may be variously provided to correspond to the configurations of the storage spaces.

For example, the refrigerating compartment door 21 may be provided in a pair to cover the refrigerating compartment 12. The refrigerating compartment doors 21 may be disposed on both left and right sides and rotatably connected to the cabinet 11 through hinge devices 15 to open and close the refrigerating compartment 12.

Both the left and right sides of the pair of refrigerating compartment doors 21 may be independently rotatably provided. Thus, the one refrigerating compartment 12 may be partially or wholly opened and closed by using the pair of refrigerating compartment door 21. The hinge devices 15 may be disposed on upper and lower ends of the refrigerating compartment door 21 so that the refrigerating compartment door 21 is rotatable. Since the refrigerator 1 is provided as the built-in type that is installed in the form of the furniture 2, the hinge devices may not interfere with the furniture 2, to which the panel 3 is adjacent, when the refrigerating compartment door 21 is opened and closed.

A covering device 24 may be disposed between the pair of refrigerating compartment doors 21. In the state in which the pair of refrigerating compartment doors 21 are closed, the covering device 24 may cover a gap between the pair of refrigerating compartment doors 21 to prevent cold air within the refrigerating compartment 12 from leaking.

The freezing compartment door 22 and the switching door 23 may be slidably inserted and withdrawn to open and close the freezing compartment 13 and the switching compartment 14. Also, an accommodation member may be coupled to the freezing compartment door 22 and the switching compartment door 23 to provide a structure as a drawer. The freezing compartment door may be directly or indirectly coupled to the insertion/withdrawal device such as a rail disposed inside the cabinet 11 so as to be inserted and withdrawn like the drawer.

The panel 3 may be mounted on front surfaces of the refrigerating compartment door 21, the freezing compartment door 22, and the switching compartment door 23. Thus, when the refrigerator 1 is installed, the outer appearance of the refrigerator 1 may be defined by the panel 3. Also, in the state in which the panel 3 is attached to the front surfaces of the refrigerating compartment door 21, the freezing compartment door 22, and the switching compartment door 23, since a gap between the doors are very close to each other, the refrigerator 1 may be seen as a portion of the furniture 2.

Figure 4:
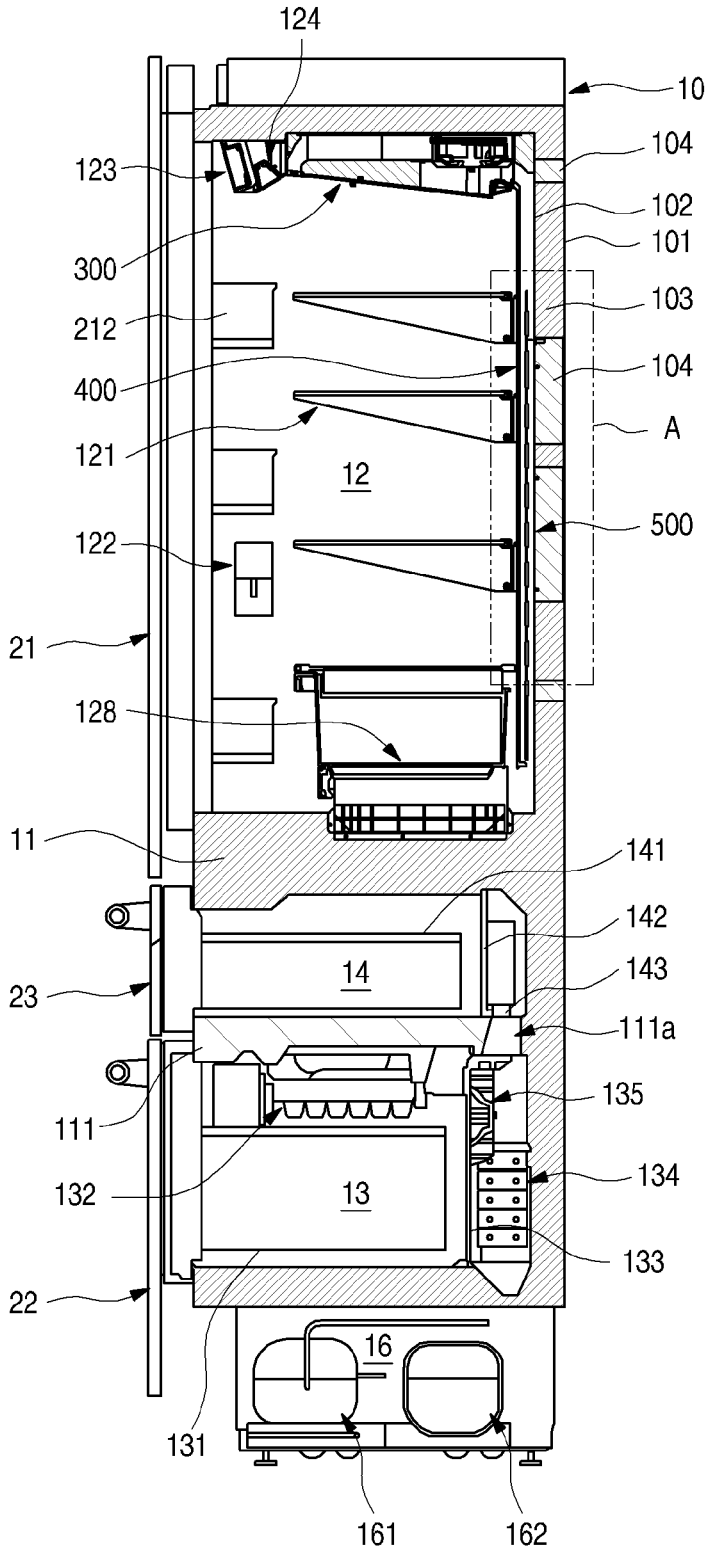
FIG. 4 is a cross-sectional view of the refrigerator.

FIG. 4 is a cross-sectional view of the refrigerator.

As illustrated in the drawing, the cabinet 11 may include an outer case 101 defining an outer surface thereof and an inner case 102 spaced apart from the outer case 101 to define an inner surface thereof. The inner case 102 may be made of a metal material such as stainless steel to define at least a portion of an inner surface of the refrigerator. Due to the arrangement of the inner case 102, when viewing the inside of the refrigerator 1, an elegant image may be displayed, and the inside of the refrigerator 1 may be more cooled.

Also, the entire region within the refrigerator 1 may be cooled through conduction. An insulation member 103 may be filled between the outer case 101 and the inner case 102 to insulate the inside of the refrigerator 1 from the outside of the refrigerator 1. Also, a spacer 104 mounted to support both sides of the inner case 102 and the outer case 101 before a foaming solution is injected to mold the insulation member 103 may be disposed between the inner case 102 and the outer case 101. The spacer 104 may maintain a predetermined distance between the inner case 102 and the outer case 101 to maintain the whole shape.

Two barriers 11 and 111 may be disposed on upper and lower portions of the cabinet 11 within the cabinet 11. The switching compartment 14 and the freezing compartment 13 may be partitioned by the barriers 11 and 111.

Also, a machine room 16 may be defined in a lower end of the cabinet 11, i.e., a lower side of the freezing compartment 13. Compressors 161 and 162 and a condenser (not shown), which constitute the refrigeration cycle, may be provided in the machine room 16. The compressors 161 and 162 may be provided in two, i.e., include a first compressor 161 constituting a first refrigeration cycle for cooling the freezing compartment 13 and a second compressor 162 constituting a second refrigeration cycle for cooling the refrigerating compartment 12. That is, the freezing compartment 13 and the refrigerating compartment 12 may be individually cooled by the independent refrigeration cycles, respectively.

As described above, the two refrigeration cycles may be separately provided to effectively independently cool the spaces. Also, the separated refrigeration cycles may be provided so that the compressors 161 and 162 are designed to have proper capacities, thereby reducing sizes, i.e., heights of the compressors 161 and 162. Thus, a volume occupied by the machine room 16 may be minimized to maximize a capacity of the storage space within the cabinet 11. In addition to, the refrigeration cycles may be separately provided to reduce an amount of refrigerant provided in each of the refrigeration cycles so that the refrigerant having explosiveness is more stably used.

A first evaporator 134 constituting the first refrigeration cycle may be disposed at a rear side of the freezing compartment 13. In general, the first evaporator 134 may be provided in a fin tube type. Thus, the fin tube may be called an evaporator. Also, a freezing compartment grill fan 133 may be disposed at a rear side of the freezing compartment, and the first evaporator 134 and a freezing compartment blower fan 135 may be provided in an inner space defined by the freezing compartment grill fan 133. The cold air within the freezing compartment evaporator 134 may be concentratedly supplied into the freezing compartment 13 by passing through the freezing compartment grill fan 133 by the freezing compartment blower fan 135.

A freezing compartment drawer 131 that is capable of being inserted and withdrawn together with the freezing compartment door 22 may be provided in the freezing compartment door 22. Also, an ice maker 132 for making ice may be provided in the freezing compartment 13.

A switching compartment drawer 141 that is capable of being inserted and withdrawn together with the switching compartment door 23 may be provided in the switching compartment 14. A switching compartment grill fan 142 may be provided at a rear side of the switching compartment 14. Also, a switching compartment duct 111*a* communicating with a space in which the first evaporator 134 is disposed may be provided at a rear side of the switching compartment grill fan 142. The switching compartment duct 111*a* may provide a passage so that the cold air of the first evaporator 134 is introduced into the switching compartment 14.

A damper 143 may be provided in the switching compartment duct 111*a*. The damper 143 may be configured to open and close the switching compartment duct 111*a*. The supply of the cold air into the switching compartment 14 may be selectively adjusted according to a degree of opening of the damper 143 or the opening/closing of the damper 143. Thus, the inside of the switching compartment 14 may be maintained at a set temperature by the damper 143. A switching compartment blower fan (not shown) may be further provided in a space defined by the switching compartment duct 111*a* or the switching compartment grill fan 142. The supply of the cold air into the switching compartment 14 may be more effectively performed by the switching compartment blower fan. Also, the switching compartment blower fan may be interlocked with the operation of the damper 143. Alternatively, the switching compartment 14 may have a separate independent cooling structure by a thermoelectric element or a refrigeration cycle.

The evaporator cover module 400 may be disposed on the rear surface of the refrigerating compartment 12. The evaporator cover module 400 may be disposed on the rear surface of the refrigerating compartment 12. Also, a space in which the second evaporator 500 is disposed may be defined between the evaporator cover module 400 and the rear surface of the inner case 102. The second evaporator 500 may have a plate shape as the roll bond type evaporator. Thus, the second evaporator 500 may be called a roll bond evaporator or a plate-type evaporator. The second evaporator 500 may be disposed between the evaporator cover module 400 and the inner case 102 to cool air flowing along the space in which the second evaporator 500 is accommodated.

A cold air supply module 300 may be disposed on the top surface of the refrigerating compartment 12. The refrigerating compartment blower fan 370 may be provided in the cold air supply module 300 to forcibly supply the cold air within the refrigerating compartment 12. Also, the cold air supply module 300 may be connected to the evaporator cover module 400, and air within the refrigerating compartment 12 may be cooled by passing through the inside of the evaporator cover module 400 and then be supplied to the refrigerating compartment 12 through the cold air supply module 300.

A display module 123 for displaying an operation state of the refrigerator 1 may be further disposed on the top surface of the refrigerating compartment 12. Lighting devices 124 and 125 for brightening the inside of the refrigerator 1 may be further provided in the display module 123 and the cold air supply module 300.

A plurality of shelves and drawers may be provided in the refrigerating compartment 12. A door basket 212 may be disposed on the rear surface of the refrigerating compartment door 21 to provide various accommodation spaces in the refrigerator 1.

Figure 5:
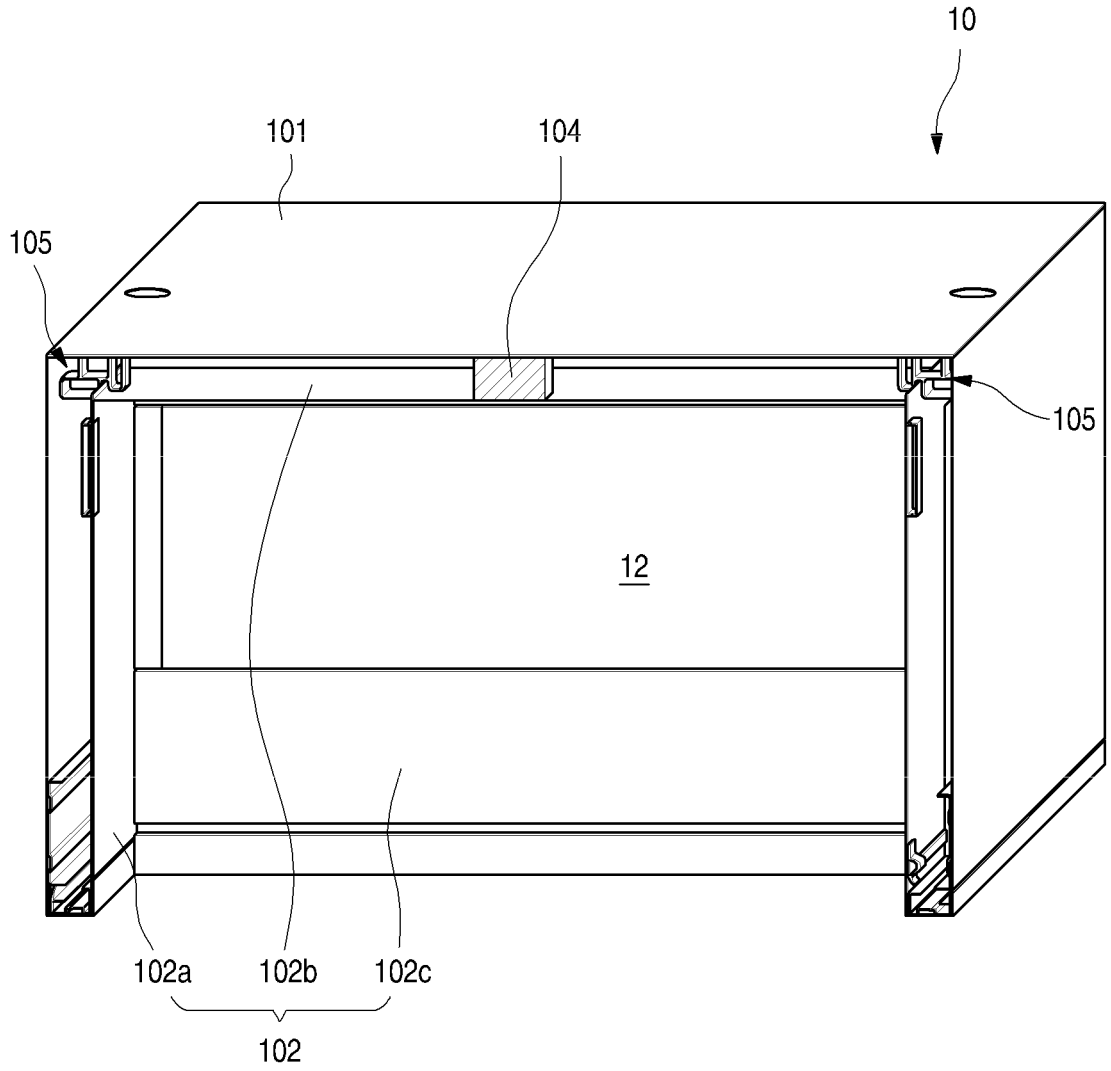
FIG. 5 is a cutaway perspective view illustrating a cabinet of the refrigerator.

FIG. 5 is a cutaway perspective view illustrating the cabinet of the refrigerator.

A configuration of the cabinet 10 will be described in more detail with reference to the drawing. The cabinet 10 may include an outer case 101 defining an outer appearance of both the surfaces and the rear surface except for the front surface of the refrigerator 1 and an inner case 102 disposed to be spaced apart from the outer case 101 to define the inside of the storage space.

Although the inner case 102 defines the refrigerating compartment in FIG. 5, the freezing compartment 13 and the switching compartment 14 in addition to the refrigerating compartment 12 may be defined by the inner case 102, which are separately provided.

The outer case 101 may be made of a metal material such as stainless and be configured so that a plate material is bent to define both left and right surface and the rear surface of the refrigerator 1. Also, the outer case 101 may be further bent to define at least a portion of the front surface of the cabinet 10 coming into contact with the rear surfaces of the doors 21, 22, and 23.

The inner case 102 may be disposed to be spaced apart from the outer case 101 and define the inner surface of the refrigerating compartment 12. The inner case 102 may also be made of a metal material such as stainless and also be made of a plate material so that each of the surfaces of the refrigerating compartment 12 is defined by the inner case of the independent plate shape.

That is, the inner case 102 may include left and right plates 102*a*, a rear plate 102*b*, a top plate (not shown), and a bottom plate 102*c*, which respectively define both left and right surfaces, a rear surface, and top and bottom surfaces and each of which is provided as a single plate. The plates may come into contact with or coupled to each other to define a shape of the inner surface of the refrigerating compartment 12.

The inner case 102 may be provided so that a lighting device and accommodation members such as a drawer and a shelf, which are disposed therein, are easily mounted. Also, additional molding such as forming and cutting may be performed for entrance of wires or the water supply tube 600.

Also, the insulation member 103 may be disposed between the inner case 102 and the outer case 101 to insulate the inside of the refrigerating compartment 12. The insulation member 103 may be foamed and molded by filling a foaming solution. In the state in which the outer case 101 and the inner case 102 are assembled with each other, the foaming solution may be injected.

A corner support member 105 may be disposed between edges of the inner case 102 and the outer case 101. The corner support member 105 may be disposed to support each of the edge of the inner case 102 and the edge of the outer case 101. Particularly, the corner support member 105 may be disposed to support ends of the side plate 102*a* and the rear plate 102*b* of the inner case 102, which are connected to each other. The corner support member 105 may be formed by injection-molding a plastic material to support the edges of the inner case 102 and the outer case 101 so that the edges are not deformed. Also, a plurality of openings may be defined in the corner support member 105. Thus, when the foaming solution is injected, the foaming solution may pass through the plurality of openings.

Also, a spacer 104 may be further disposed between the inner case 102 and the outer case 101 to maintain a distance between the inner case 102 and the outer case 101.

Figure 6:
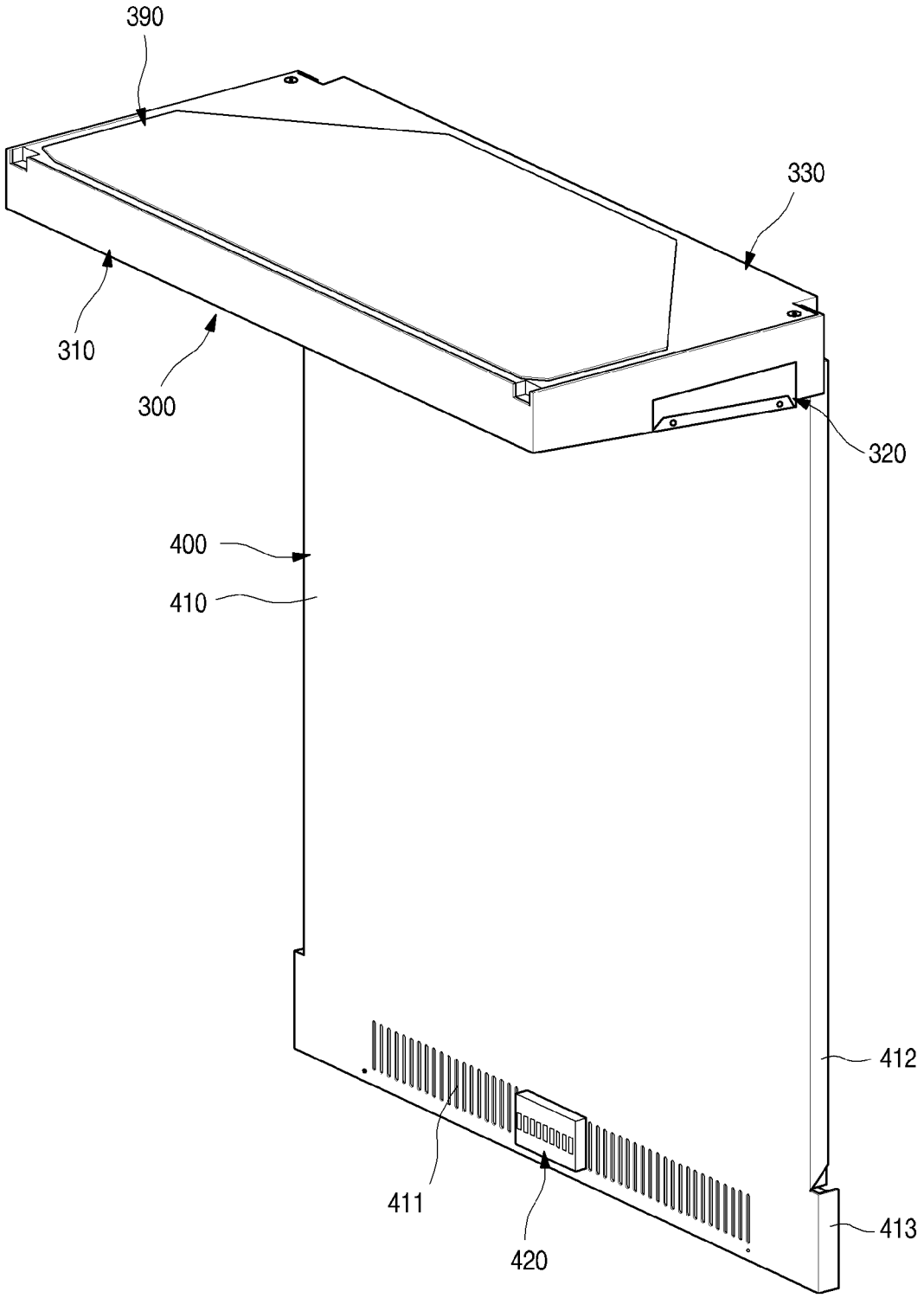
FIG. 6 is a perspective view illustrating a state in which a cold air supply module and an evaporator cover module are coupled to each other according to an embodiment.
Figure 7:
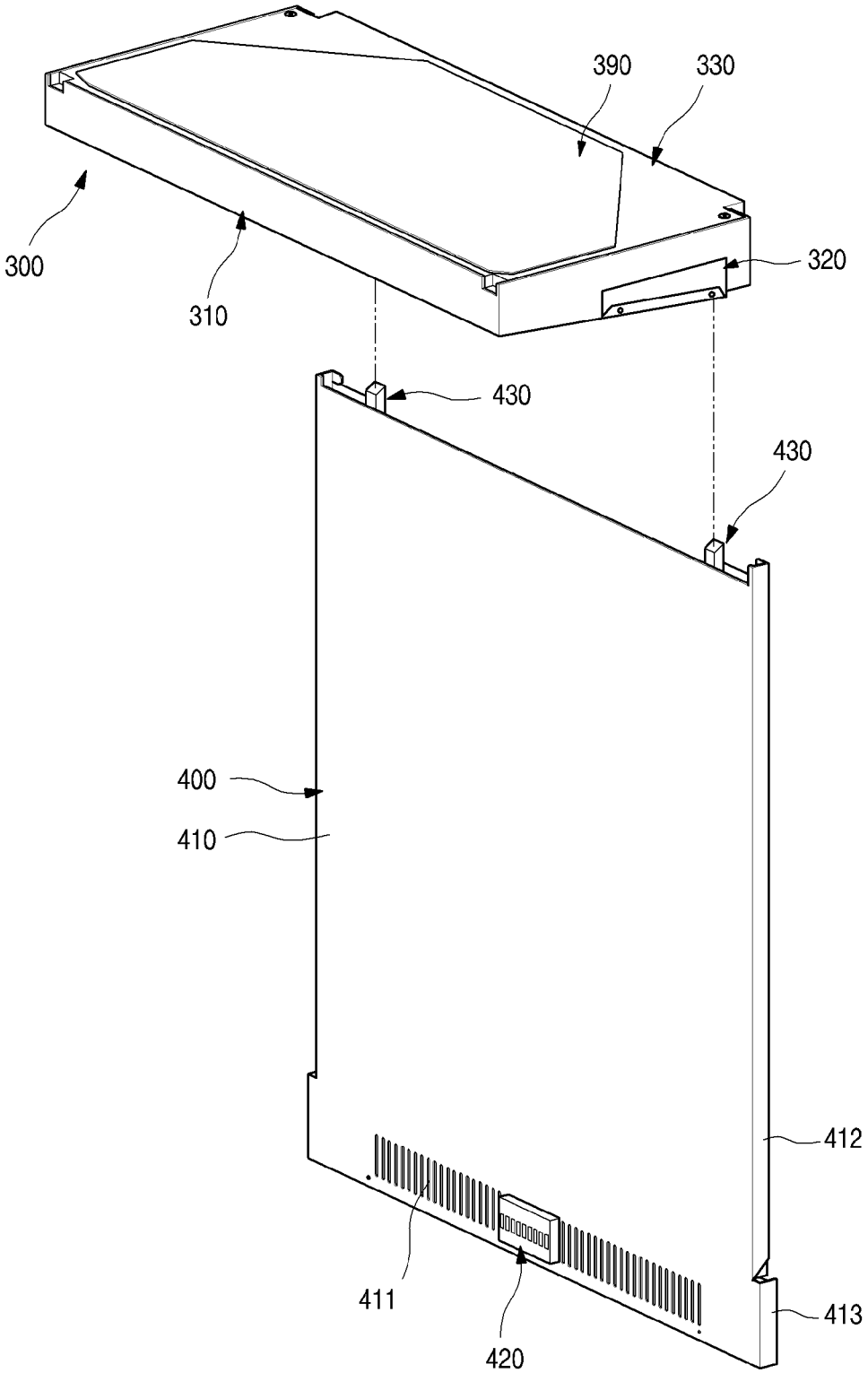
FIG. 7 is an exploded perspective view illustrating a coupling structure between the cold air supply module and the evaporator cover module.

FIG. 6 is a perspective view illustrating a state in which the cold air supply module and the evaporator cover module are coupled to each other according to an embodiment. Also, FIG. 7 is an exploded perspective view illustrating a coupling structure between the cold air supply module and the evaporator cover module.

As illustrated in the drawings, the cold air supply module 300 be coupled to the evaporator cover module 400 to communicate with the passage into which the cold air is supplied. Also, the cold air supply module 300 may be disposed on an upper end of the refrigerating compartment 12 to define an outer appearance of at least a portion of the top surface of the refrigerating compartment 12. The evaporator cover module 400 may be disposed on the rear surface of the refrigerating compartment 12 to define an outer appearance of at least a portion of the rear surface of the refrigerating compartment 12.

The evaporator cover module 400 may be coupled to a rear end of a bottom surface of the cold air supply module 300. In this state, the evaporator cover module 400 may define the top and rear surfaces of the refrigerating compartment 12. Also, the evaporator cover module 400 and the cold air supply module 300 may communicate with each other. Thus, the cold air may flow along the evaporator cover module 400 and the cold air supply module 300.

The evaporator cover module 400 may have a size corresponding to that of the rear surface of the refrigerating compartment 12, and a suction hole 411 may be defined in the evaporator cover module 400 to allow the air within the refrigerating compartment 12 to be introduced into the evaporator cover module 400. Also, a space in which the second evaporator 500 is accommodated may be provided in the evaporator cover module 400.

The cold air supply module 300 may have a size corresponding to that of the top surface of the refrigerating compartment 12, and a refrigerating compartment blower fan 370 may be provided in the cold air supply module 300. The refrigerating compartment blower fan 370 may be disposed at a rear side that is adjacent to the evaporator cover module 400. Thus, the cold air supply module 300 may have a shape having a thickness that gradually increases from the front side to the rear side. Also, a plurality of discharge ports 317 and 318 may be disposed on the bottom surface of the cold air supply module 300 to discharge the cold air guided through the cold air supply module 300 to the inside of the refrigerating compartment 12.

The cold air supply module 300 may be mounted on the top surface of the refrigerating compartment 12 in the state in which the evaporator cover module 400 is mounted inside the refrigerating compartment 12. The rear end of the bottom surface of the cold air supply module 300 and the upper end of the evaporator cover module 400 may communicate with each other by the mounting of the cold air supply module 300.

Hereinafter, a structure of the cold air supply module will be described in more detail with reference to the accompanying drawings.

Figure 8:
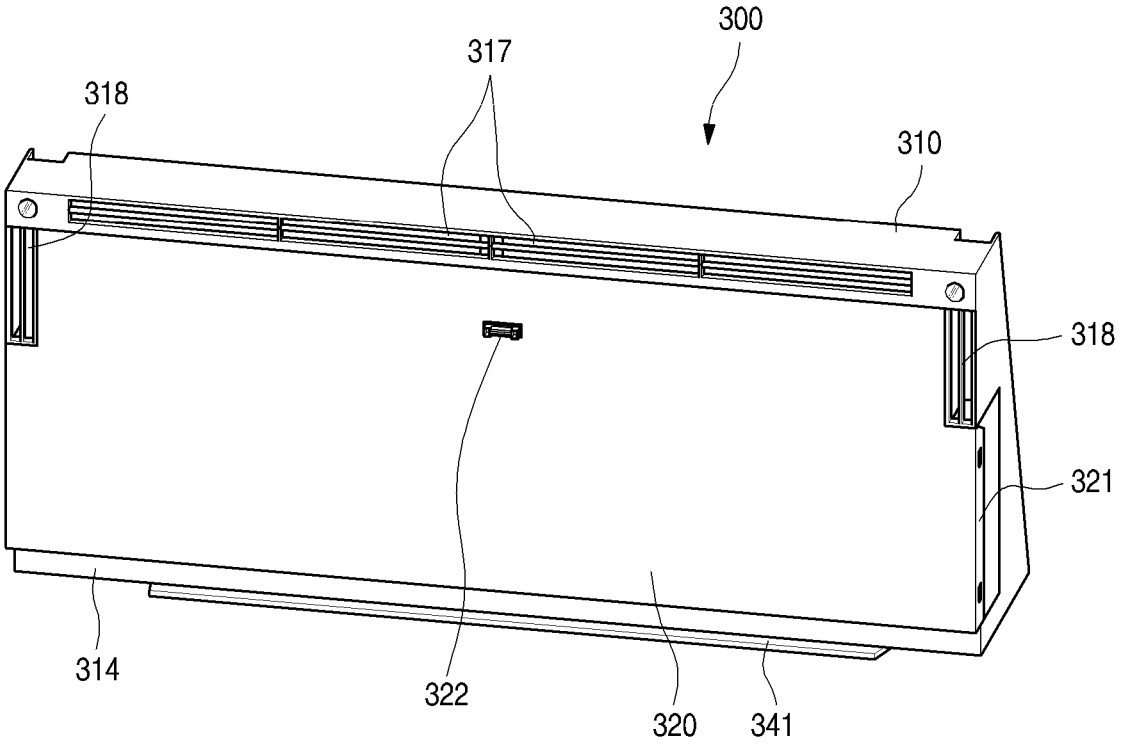
FIG. 8 is a perspective view when viewed from a lower side of the cold air supply module.
Figure 9:
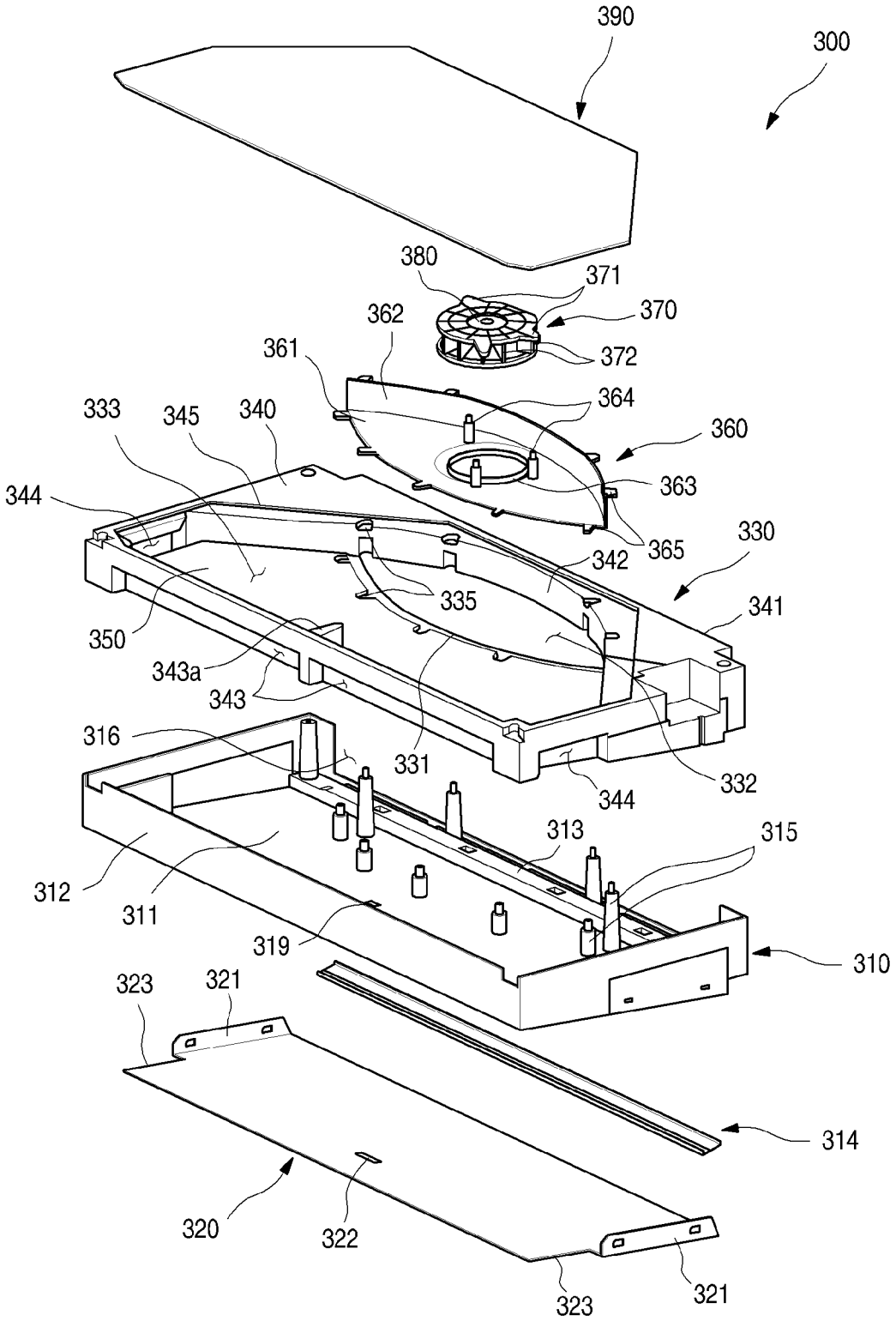
FIG. 9 is an exploded perspective view of the cold air supply module when viewed from a front side.
Figure 10:
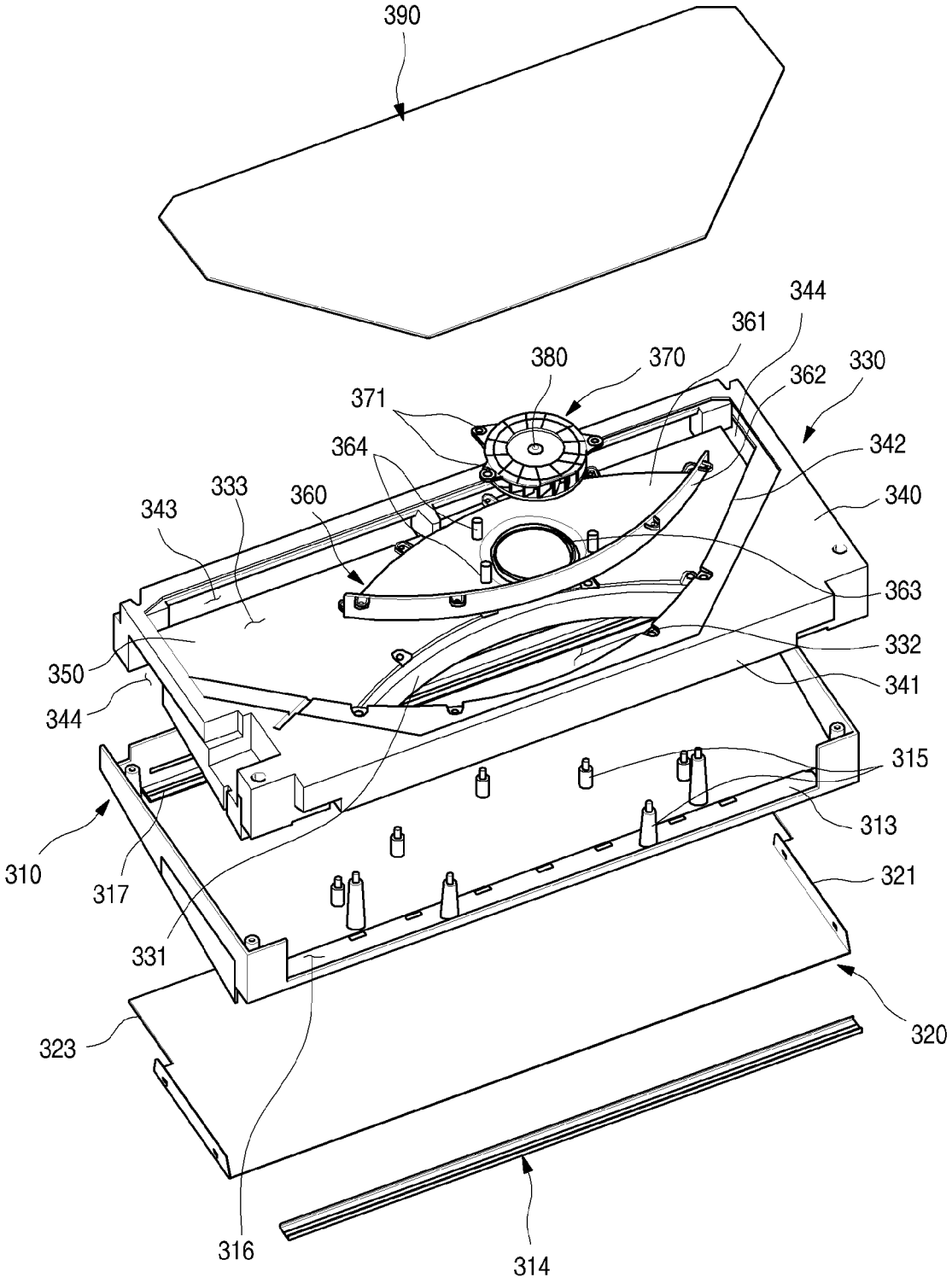
FIG. 10 is an exploded perspective view of the cold air supply module when viewed from a rear side.

FIG. 8 is a perspective view when viewed from a lower side of the cold air supply module. Also, FIG. 9 is an exploded perspective view of the cold air supply module when viewed from a rear side. Also, FIG. 10 is an exploded perspective view of the cold air supply module when viewed from a front side.

As illustrated in the drawings, the cold air supply module 300 may include a lower case 310 and an upper case 390, which define an outer appearance thereof, and a passage formation part 30 between the upper case 390 and the lower case 310.

The lower case 310 may be injection-molded by using a plastic material and include a base 311 defining a bottom surface thereof and edges 312 extending upward from both side surfaces and front surface of the base 311.

Discharge ports 317 and 318 through which the cold air is discharged may be disposed on a front end and both side ends of the base 311, respectively. The discharge ports 317 and 318 may include a front discharge port 317 disposed on a front end of the base 311 and side discharge ports 318 disposed on both side ends of the base 311. Each of the front discharge port 317 and the side discharge ports 318 may have a grill shape.

The front discharge port 317 may lengthily extend from one end to the other end of the front end of the base 311. Thus, the cold air discharged from the front discharge port 317 may be supplied downward from the front end of the top surface of the refrigerating compartment 12.

The side discharge ports 318 may be disposed on both the side ends of the base 311, i.e., the front portion of the base 311. That is, the side discharge ports 318 may respectively extend backward from both ends of the front discharge port 317 up to an approximately central point of the base 311. Thus, the side discharge ports 318 may be provided downward from front portions of both side ends of the top surface of the refrigerating compartment 12, respectively.

A base plate 320 may be mounted on the base 311. The base plate 320 may be made of the same material as the inner case 102 and have a plate shape to define an outer appearance of the bottom surface of the cold air supply module 300 exposed to the inside of the refrigerating compartment 12.

The base plate 320 may be made of a plate-shaped stainless material. An area of the base plate 320, which corresponds to the front discharge port 317 and the side discharge ports 318, may be cut. Thus, when the base plate 320 is mounted on the base, the base plate 320 may define the top surface of the refrigerating compartment 12. Here, the front discharge port 317 and the side discharge ports 318 may be exposed.

A bent part 321 may be disposed on each of both ends of the base plate 320. The bent part 321 may be coupled to an edge of the base 311 to firmly maintain the coupled state between the base plate 320 and the base 311. A rear end of the base plate 320 may extend up to a light cover 314 that will be described below. Also, a sensor hole 322 may be defined in a side of a center of the base plate 320.

A sensor mounting part 319 may be disposed on a side of the base 311, which corresponds to the sensor hole 322. The sensor mounting part 319 may be configured so that a temperature sensor for measuring an inner temperature of the refrigerating compartment 12 is mounted.

A plurality of supporting bosses 315 extending upward may extend inside the base 311. The supporting bosses 315 may pass through the passage formation part 330 and then be coupled to a fan bracket 360 that will be described below. The supporting bosses 315 may support the fan bracket 360 and be provided in plurality along a circumference of the fan bracket 360.

The passage formation part 330 may be filled into the base 311 and mounted on the base 311 to provide a flow passage for the cold air. The passage formation part 330 may be made of a Styrofoam material having an insulation property and be mounted on the base 311 in the state in which the passage formation part 30 is molded.

The passage formation part 330 may include an upper part 340 and a lower part 350 as a whole. The upper part 340 may define an upper portion of the passage formation part 330 and be filled into an upper space of the base 311. Also, the lower part 350 may define a lower portion of the passage formation part 330 and be filled into a lower space of the base 311. Thus, when the passage formation part 330 is mounted on the lower case 310, an upper passage 333 and a lower passage may be provided. The upper passage 333 and the lower passage 332 may communicate with each other by a communication hole 331.

In detail, the upper part 340 may define an upper circumference of the passage formation part 330 to provide the upper passage 333 that is opened upward.

A rear end of the upper part 340 may further protrude than a rear end of the base 311. Thus, an inlet part 341 may be disposed between the rear end of the base 311 and the upper part 340. The opened upper end of the evaporator cover module 400 may be inserted into or come into contact with the inlet part 341. Thus, the cold air flowing upward along the evaporator cover module 400 may be introduced into the passage formation part 330. Also, the inlet part 341 may have a rounded bottom surface. Thus, the cold air vertically flowing upward may flow along a rounded guide surface 341*a* of the inlet part 341 and then be guided in a direction crossing the evaporator cover module 400.

A discharge guide surface 342 may be disposed on the upper part 340. The discharge guide surface 342 may guide the cold air blown by the refrigerating compartment blower fan 370 to allow the cold air to flow to the front discharge port 317 and the side discharge ports 318. The discharge guide surface 342 may define a rear surface of the upper passage 333 and have a predetermined curvature to connect the rear ends of the side discharge ports, which are disposed on both the sides, to each other. Here, the discharge guide surface 342 may be disposed at a rear side of the refrigerating compartment blower fan 370. Also, a portion of the discharge guide surface 342 may define a portion of the communication hole 331.

A front opening 343 may be defined in a front end of the upper part 340. The front opening 343 may define a front end of the upper passage 333 and be defined at a corresponding position to communicate with the front discharge port 317. A distribution part 343*a* for dispersing air passing through the front opening 343 may extend backward from an approximately central portion of the front opening 343. The distribution part 343*a* may be configured to partition the front opening 343 and have both inclined side surfaces.

Also, a side opening 344 may be defined in each of both side ends of the upper part 340. The side opening 344 may define a portion of both side ends of the upper passage 333 and be defined at a corresponding position to communicate with each of the side discharge ports 318.

The lower part 350 may define a lower of the passage formation part 330. That is, the lower part 350 may provide a passage through which the cold air introduced into the cold air supply module 300 is discharged to the front discharge port 317 and the side discharge ports 318 via the refrigerating compartment blower fan 370.

In detail, the lower part 350 may be disposed at a position corresponding to a space of the upper passage 333 and be filled into a space between the upper part 340 and the base 311. Thus, in the state in which the passage formation part 330 is mounted, a top surface of the lower part 350 may define the upper passage 33, and a bottom surface of the lower part 350 may come into contact with the base 311 and be filled into the lower case 310.

Here, a front end and both side ends of the lower part 350 may extend up to the front opening 343 and the side openings to provide passages through which the front opening 343 communicates with the front discharge port 317, and the side openings 344 communicates with the side discharge ports 318.

Also, the rear end of the lower part 350 may define a front portion of the communication hole 331. The rear end of the lower part 350 may be recessed forward in a rounded shape to define a portion of the lower passage 332.

The communication hole 331 may be defined by the rear end of the lower part 350 and the discharge guide surface 342. The communication hole 331 may have a shape of which a width gradually decreases from a center thereof in both side directions, and both ends come into contact with each other. The communication hole 331 may have a size, in which the refrigerating compartment blower fan 370 is accommodated in a center thereof.

A boss hole 335 through which the supporting boss 315 passes may be defined along the communication hole 331. An upper end of the supporting boss extending upward by passing through the boss hole 335 may be coupled to the fan bracket 360 through a screw.

The fan bracket 360 may be mounted to cover the communication hole 331. The fan bracket 360 may include a shroud 361 having a shape corresponding to the communication hole 331 and a bracket edge 362 defining a circumference of the shroud 361.

A plurality of bracket coupling parts 365 may be disposed along the outside of the shroud 361. The bracket coupling part 365 may be disposed at a position corresponding to a boss hole 335 defined in the lower part 350 and coupled to an upper end of the supporting boss 315 passing through the boss hole 335.

An orifice 363 may be defined in a center of the shroud. The orifice 363 may be disposed at a position corresponding to the refrigerating compartment blower fan 370 and substantially serve as a suction passage for air. Thus, a circumference of the orifice 363 may extend in the same shape as a bell mouth so that air is more smoothly suctioned.

A fan support 364 may be disposed outside the orifice 363. The fan support 364 may support the refrigerating compartment blower fan 370 and be coupled to a blower fan coupling part 371.

Although not shown in detail, a fan motor 380 having a turbo fan structure may be mounted at a center of the refrigerating compartment blower fan 370 so that air is suctioned in a shaft direction and discharged in a circumferential direction. Also, a plurality of blades 372 may be disposed on the refrigerating compartment blower fan 370 in the circumferential direction. Thus, the air within the lower passage, which is suctioned through the orifice 363, may be discharged into the upper passage 333 while being discharged in the circumferential direction by the refrigerating compartment blower fan 370.

The bracket edge 362 may extend along a rear end of the shroud from the fan bracket 360. The bracket edge 362 may be closely attached to the discharge guide surface 342. Also, the bracket coupling part 365 that vertically protrudes may be disposed along an upper end of the bracket edge 362. The bracket coupling part 365 may be coupled to an upper end of the supporting boss 315 extending by passing through the upper part 340.

The fan bracket 360 and the refrigerating compartment blower fan 370 may not protrude to the outside of the passage formation part 330 in the state of being accommodated in the upper passage 333 and be covered by the upper case 390.

The upper case 390 may define the top surface of the cold air supply module 300 and cover the opened top surface of the passage formation part 330. In the state in which the upper case 390 is mounted, the upper case 390 may cover the upper passage 333 and also cover the fan bracket 360, which is disposed on the upper passage 333, and the refrigerating compartment blower fan 270.

Also, an upper case mounting part 345 that is recessed in a space corresponding to the upper case 390 may be disposed on the top surface of the passage formation part 330. In the state in which the upper case 390 is mounted, the top surface of the upper case 390 may have the same plane as the top surface of the passage formation part 330 on the upper case mounting part 345.

When the cold air supply module 300 is mounted inside the refrigerating compartment 12, the top surfaces of the upper case 390 and the passage formation part 330 may come into contact with the top surface of the inner case 102. Also, both left and right ends of the cold air supply module 300 may come into contact with both left and right surfaces of the inner case 102. Also, a rear end of the cold air supply module 300, more particularly, the inlet part 341 may come into contact with the evaporator cover module 400 to provide a passage through which the cold air flows.

Hereinafter, the evaporator cover module 400 will be described in with reference more detail to the drawing.

Figure 11:
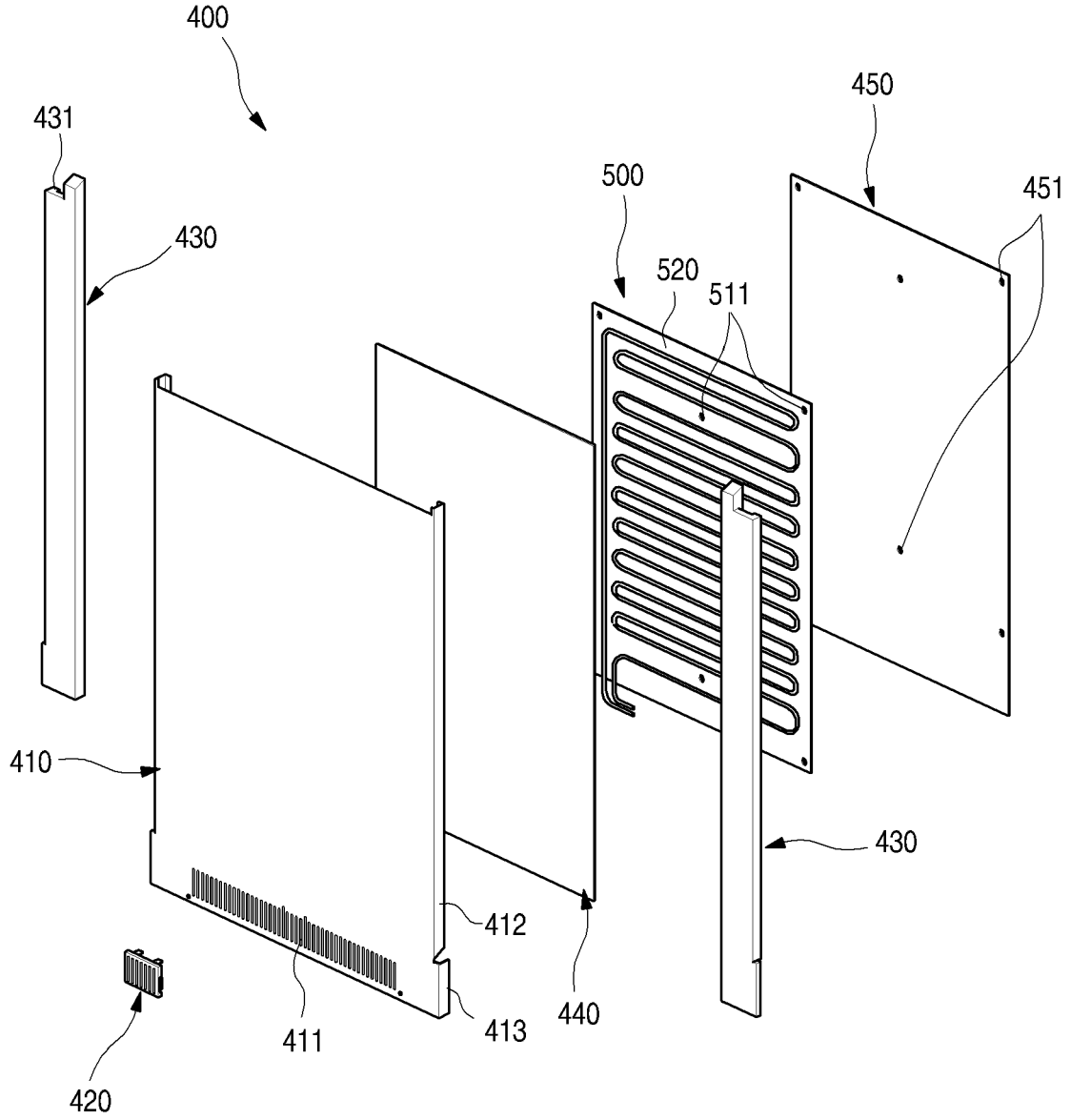
FIG. 11 is an exploded perspective view illustrating a coupling structure between an evaporator cover module and a roll bond evaporator when viewed from the front side.
Figure 12:
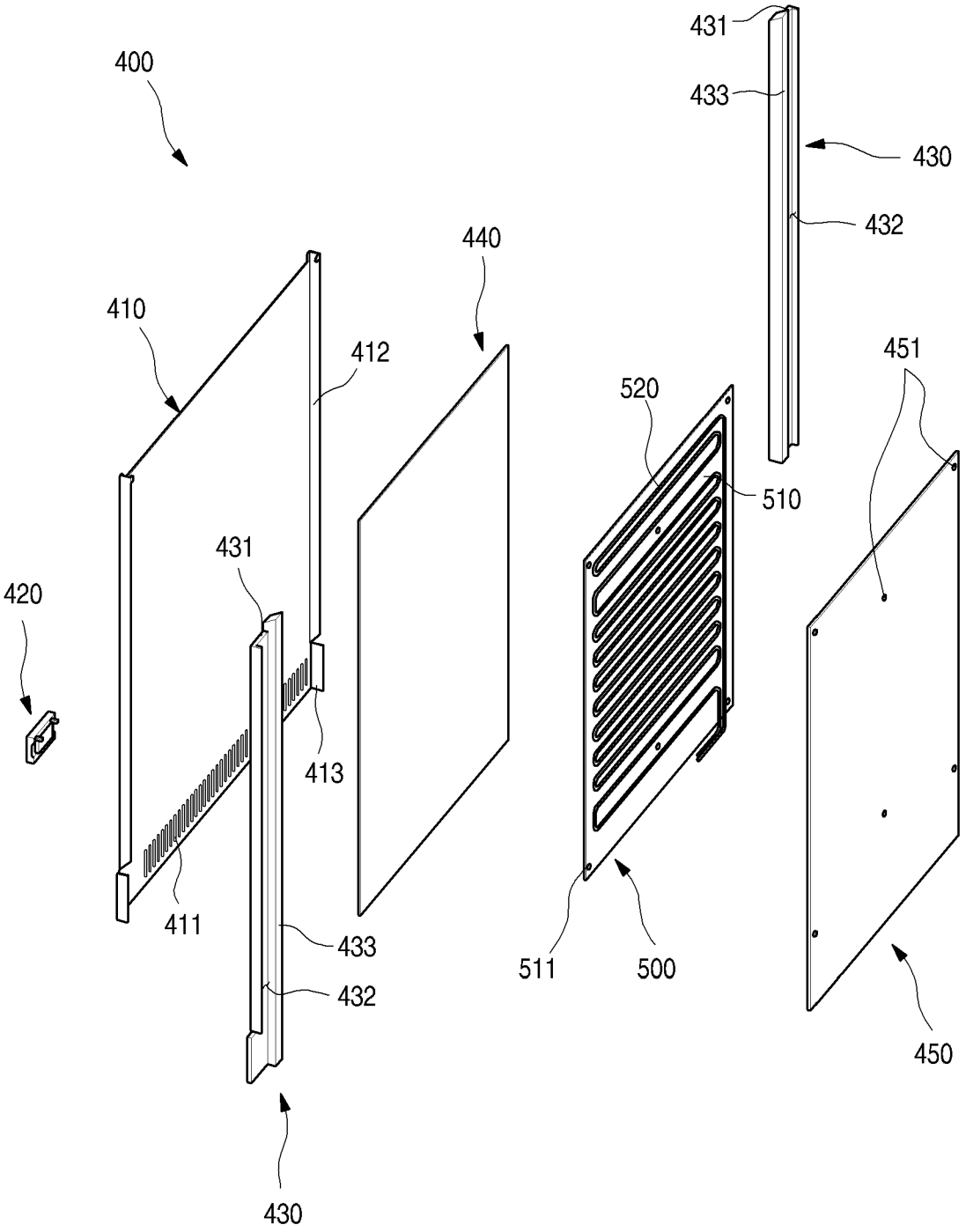
FIG. 12 is an exploded perspective view of a coupling structure between the evaporator cover module and the roll bond evaporator when viewed from the rear side.

FIG. 11 is an exploded perspective view illustrating a coupling structure between the evaporator cover module and the roll bond evaporator when viewed from the front side. Also, FIG. 12 is an exploded perspective view of the coupling structure between the evaporator cover module and the roll bond evaporator when viewed from the rear side.

As illustrated in the drawing, the evaporator cover module 400 may be disposed on an inner rear surface of the refrigerating compartment 12. The evaporator cover module 400 may define the rear surface of the refrigerating compartment 12 and also provide a space in which the second evaporator 500 is mounted and a cold air flow space.

The evaporator cover module 400 may include the rear plate 410, a first insulation member, a second insulation member 450, and side ducts 430.

In detail, the rear plate 410 may define an outer appearance of the evaporator cover module 400, i.e., define the rear surface of the refrigerating compartment 12. The rear plate 410 may be made of a metal material such as stainless steel like the inner case 102.

A suction hole 411 may be defined in a lower portion of the rear plate 410. The suction hole 411 may be defined by a plurality of holes passing through the rear plate 410 and have a grill shape.

An air purification module 420 may be mounted on the suction hole 411. The air purification module 420 may be configured to purify air by using a filter or a catalyst and be detachably disposed on the suction hole 411.

The rear plate 410 may be made of a plate-shaped material and have both side surfaces that are bent to define a heat-exchange space 460 in which the rear plate 410 is spaced apart from the rear surface of the inner case 102. The heat-exchange space 460 may be a space between the first insulation member 440 and the second insulation member 450 and also be defined as a space in which the second evaporator 500 is disposed.

In detail, an upper bent part 412 and a lower bent part 413 may be disposed on both side ends of the rear plate 410. The upper bent part 412 may be bent backward so that both bent ends of the upper bent part 321 are spaced apart from the inner case 102. Thus, a shelf mounting member 470 on which shelves 121 disposed in the refrigerating compartment 12 are mounted may be disposed between the upper bent part 412 and the side surface of the inner case 102.

The lower bent part 413 may be bent backward, i.e., be bent backward in a state of coming into contact with both side surfaces of the inner case 102. Thus, a width between the upper bent parts 412 may be less than that between the lower bent parts 413. That is, an outer surface of the lower bent part 413 may further protrude outward from an outer surface of the upper bent part 412. Here, a protruding distance may correspond to a protruding distance of the shelf mounting member 470.

Also, the lower bent part 413 may have a height that is determined depending on a length of the shelf mounting member 470. The lower bent part 321 may extend from a lower end of the shelf mounting member to a lower end of the rear plate 410.

The side ducts 430 may be disposed on both inner left and right sides of the rear plate 410. The side ducts 430 may cover both left and right sides in the rear space of the rear plate 410 to define a space, in which the second evaporator 500 is disposed, between both the left and right sides.

Each of the side ducts 430 may be made of an insulation member such as foaming foam. In a state in which the side ducts 430 are molded, the side ducts 430 may be assembled and mounted on the rear plate 410. Also, the side ducts 430 may be fixed and mounted inside the refrigerating compartment 12 in a state in which all the rear plate 410 and the first insulation member 440 are coupled.

A distance between the side ducts 430 disposed on both left and right sides may correspond to a width of the second evaporator 500. A rear space of the rear plate 410, which is defined by the side ducts 430, may have a horizontal width correspond to that of the second evaporator 500. Thus, air passing through the heat-exchange space 560 may be effectively cooled by passing through the second evaporator 500.

The side ducts 430 may vertically extend along the rear plate 410 and have one side having a shape corresponding to each of the upper bent part 412 and the lower bent part 413 of the rear plate 410 and the other side defining a side surface of the heat-exchange space 460 in which the second evaporator 500 is accommodated.

The side duct 430 may have a thickness corresponding to a height of each of the upper bent part 412 and the lower bent part 413 and come into contact with the inner case 102 to define a space in which the second evaporator 500 is disposed.

The side duct 430 may include a duct support part 433 and a tube guide part 432.

The duct support part 433 may define one side of the side duct 430 coming into contact with a side of the second evaporator 500 and support a rear wall of the inner case 102 and the rear plate 410. That is, a thickness of the evaporator cover module 400 and a thickness of a passage of the space in which the second evaporator 500 is disposed may be determined by the duct support part 433.

The duct support part 433 may extend from an upper end to a lower end of the side duct 430 to partition the inside of the evaporator cover module 400 from the outer space. Also, the upper end of the duct support part 433 may further protrude from the rear plate 410 to provide a duct coupling part 431.

Also, the duct support part 433 may be disposed on a side of the tube guide part 432 and have a predetermined width to prevent the cold air of the second evaporator 500 from being excessively transferred to the tube guide part 432. Thus, even though the water supply tube 600 is disposed in the tube guide part 432, the freezing of the water supply tube 600 may be prevented.

A vertically extending tube guide part 432 may be disposed on a rear surface of each of the side ducts 430. The tube guide part 432 may be recessed from an upper end to a lower end of the side duct 430 and provided so that a water supply tube 600 or wires, which are guided to the refrigerating compartment 12, are disposed.

The tube guide part 432 may vertically extend along a lateral end of the duct support part 433 and be disposed in a vertical length direction of the side duct 430. Also, a portion corresponding to the tube guide part 432 may have a thickness significantly less than that of the duct support part 433 to correspond to a thickness of the first insulation member 440.

As described above, the side duct 430 may secure the heat-exchange space within the evaporator cover module 400 and the space in which the water supply tube 600 is disposed by the shape of the side duct 430.

A duct coupling part 431 that is stepped may be disposed on an upper end of the side duct 430. The duct coupling part 431 may be inserted into the inside of the inlet part 341 of the passage formation part 330 when the cold air supply module 300 and the evaporator cover module 400 are coupled to each other. Thus, the cold air supply module 300 and the evaporator cover module 400 may be maintained in the state in which the cold air supply module 300 and the evaporator cover module 400 are coupled to each other within the refrigerating compartment 12, and also, the passages between the cold air supply module 300 and the evaporator cover module 400 may communicate with each other.

The first insulation member 440 may be disposed on the rear surface of the rear plate 410. The first insulation member 440 may have a plate shape and made of an insulation member having a thin thickness. The first insulation member 440 may be made of a vacuum insulation member or a high-density foam material.

The first insulation member 440 may extend from an upper end of the suction hole 411 to the upper end of the rear plate 410 and have a size coming into contact with both ends of the side duct 430. Thus, the first insulation member 440 may be mounted to prevent a large amount of cold air generated in the second evaporator from thermally conducted through the rear plate 410 to affect the temperature within the refrigerator.

That is, when the first insulation member 440 is not provided, air may be cooled by the second evaporator 500 due to the structural characteristics of the rear plate 410 disposed adjacent to the second evaporator 500 and thus has a below zero temperature. As a result, the surface of the rear plate 410 may be frozen, or the rear portion within the refrigerating compartment 12 may be excessively cooled. However, the first insulation member 440 may be provided to minimize the transfer of the cold air generated in the second evaporator 500 to the rear plate 410, thereby preventing the rear plate 410 from being frozen.

Also, the second evaporator 500 may be disposed at a rear side of the first insulation member 440. The second evaporator 500 may be disposed in the heat-exchange space 460 defined by the side ducts 430 and the first insulation member 440.

The second evaporator 500 may be the roll bond type evaporator in which a refrigerant passage 520 is provided by a pair of plates 510 connected to overlap each other. That is, the second evaporator 500 may have a plate shape which is accommodated in the heat-exchange space 460. The second evaporator may have a thin thickness and a plate shape due to the structural characteristics of the roll bond type evaporator.

The second evaporator may have a width corresponding to the horizontal width of the heat-exchange space 460 and be disposed above the suction hole 411. Thus, the cold air introduced into the suction hole 411 may move upward along the second evaporator 500 and then be cooled.

The refrigerant passage 520 protruding from an outer surface of the second evaporator 500 may have a meandering shape of which both ends are repeatedly bent several times. Also, the refrigerant passage 520 may have a structure that extends in a horizontal direction. Thus, the refrigerant may slowly flow within the heat-exchange space 460 to more cool the air flowing along the inside of the heat-exchange space 460.

Also, a plurality of evaporation holes 511 may be further defined in the second evaporator 500. The evaporator holes 511 may be holes to which a screw 537 for fixing and mounting the second evaporator 500 are coupled. The evaporator holes 511 may be provided in plurality at a position corresponding to an evaporator fixing member 530 that will be described below.

The second insulation member 450 may be made of the same material as the first insulation member 440 and have a plate shape like the first insulation member 440. The second insulation member 450 may have a size corresponding to or greater than that of the second evaporator 500 to cover the second evaporator 500 at the rear side. The second insulation member 450 may be attached to an outer surface of the inner case 102.

The second insulation member 450 may be configured to prevent the cold air of the second evaporator 500 from leaking to the rear surface of the inner case 102 and have a size that is capable of defining the rear surface of the heat-exchange space 460.

Thus, the cold air flowing backward by the second insulation member 450 may be blocked by the second insulation member 450 and prevented from being transferred to the inner case 102. Particularly, when the inner case 102 is made of a metal material, and the second insulation member 450 is not provided, the cold air may unnecessarily leak to the other space except for the cooling space through the inner case 102. However, the second insulation member 450 may be provided to prevent the cold air from leaking.

A plurality of insulation holes 451 may be defined in the second insulation member 450. The insulation holes 451 may be opened so that the evaporator fixing member 530 for fixing and mounting the second evaporator 500 is inserted and be defined in a position corresponding to the evaporator holes 511.

In the state in which the evaporator cover module 400 is mounted inside the refrigerating compartment 12, the second evaporator 500 may be disposed in a space between the first insulation member 440 and the second insulation member 450. Here, the first insulation member 440 and the second insulation member 450 may be maintained at a set interval therebetween so that the air cooled by the second evaporator 500 smoothly flows.

Figure 13:
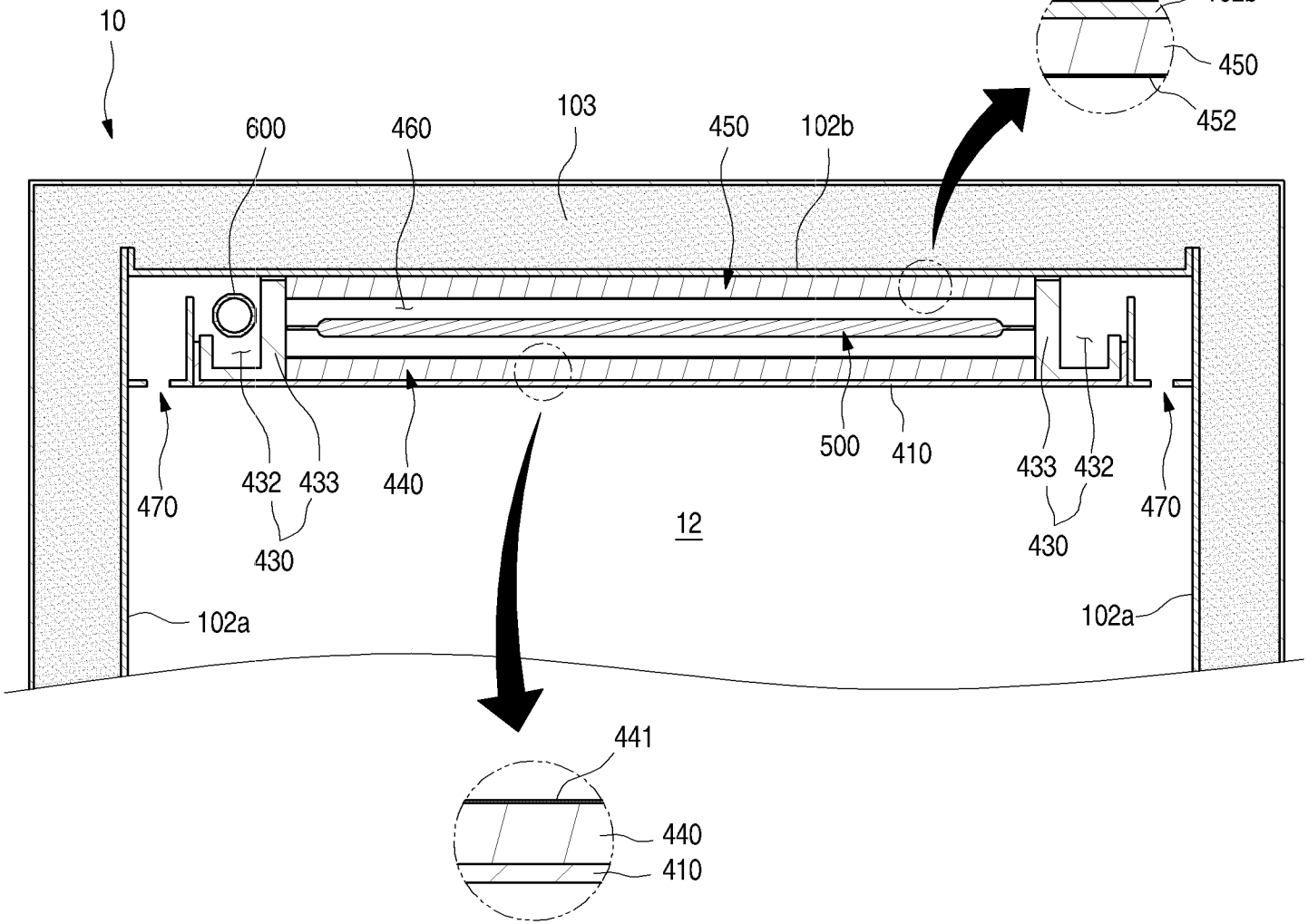
FIG. 13 is a transverse cross-sectional view illustrating a state in which the evaporator cover module and the roll bond evaporator are mounted.

FIG. 13 is a transverse cross-sectional view illustrating a state in which the evaporator cover module and the roll bond evaporator are mounted. The arranged structure of the second evaporator 500 and the evaporator cover module 400 at rear side of the refrigerating compartment 12 will be described in more detail with reference to the drawing.

As illustrated in the drawing, the rearmost wall of the refrigerating compartment 12 may be defined by the rear plate 102*b* of the inner case 102, and the rear plate 102*b* may be coupled to the left and right plates 102*a* to define the inner space of the refrigerating compartment 12. Also, the evaporator cover module 400 may be disposed at the front side of the rear plate 102*b* to define a space in which the second evaporator 500 is accommodated and a space in which the cold air flows.

The shelf mounting member 470 may be disposed on each of both left and right sides of the evaporator cover module 400. The shelf mounting member 470 may extend in a vertical direction, and a plurality of mounting holes 471 may be vertically defined in the shelf mounting member. Thus, the user may mount the cantilever type shelf 121 at a desired height. The shelf mounting member 470 may be disposed in a space between the evaporator cover module and the side plate and be disposed at the same height as the front surface of the evaporator cover module 400.

Also, the side duct 430 may be disposed on each of both side ends of the evaporator cover module 400, i.e., disposed on both sides of the second evaporator 500. The side duct 430 may be foamed and molded by using an insulation member. In the molded state, the side duct may be disposed on each of both sides of the evaporator cover module 400.

In the side duct 430, the rear plate 410 and the rear plate 102*b* may be spaced apart from each other and supported by the duct support part 433 to insulate the heat-exchange space 460 in which the second evaporator 500 is accommodated from the tube guide part 432 in which the water supply tube 600 is accommodated.

When the side duct 430 is mounted, the tube guide part 432 may be defined between the shelf mounting part 470 and the rear plate 102*b*. Also, the tube guide part 432 may be vertically opened to allow the water supply tube to be inserted and withdrawn.

That is, the water supply tube 600 may vertically extend in the inner space along the side duct 430. Thus, water may be introduced from the upper end of the refrigerating compartment 12 to pass through the tube guide part 432 and then be guided up to the lower end of the refrigerating compartment 12.

The first insulation member 440, the second evaporator 500, and the second insulation member 450 may be successively disposed forward and backward in the space between the side ducts 430. Here, the first insulation member may be attached to the rear surface of the rear plate 410, and the second insulation member 450 may be attached to the front surface of the rear plate 102*b*.

Thus, the heat-exchange space 460 in which the second evaporator 500 is disposed may be disposed in a space between the first insulation member 440 and the second insulation member 450. That is, the heat-exchange space 460 may have a thickness that is determined by the thicknesses of the first insulation member 440 and the second insulation member 450. The outer surface of the second evaporator 500 and the first and second insulation members 450 may be sufficiently spaced apart from each other so that the air smoothly flows in the state in which the second evaporator 500 is disposed.

In this state, the air suctioned into the suction hole 411 may flow upward and cooled by the second evaporator 500 while passing through the heat-exchange space 460 defined by the first insulation member 440, the second insulation member 450, and the side ducts 430. The heat-exchange space 460 may have a width and thickness that substantially corresponds to the width and thickness of the second evaporator 500 in the state in which a distance at which water droplets are not formed by surface tension is maintained when defrost water flows down along the second evaporator. Thus, air passing through the heat-exchange space 460 may be sufficiently cooled while passing through the entire second evaporator 500.

The second insulation member 450 may prevent the cold air generated in the second evaporator 500 from being permeated backward and transferred to the rear plate 102*b* of the inner case 102. When the cold air of the second evaporator 500 is transferred to the rear plate 102*b*, the cold air may be quickly transferred to the entire surface of the rear plate 102*b* due to the characteristics of the inner case made of the metal material, and then be spread to the other inner case 102 or insulation member 103, which is connected to the rear plate 102*b*, i.e., in all directions.

Since the rear plate 102*b* is substantially covered by the evaporator cover module 400 but is not covered by the rear wall exposed to the refrigerating compartment 12, the transferring of the cold air may deteriorate the efficiency of the second evaporator 500, thereby deteriorating the cooling performance.

Thus, the heat transfer to the rear side of the second evaporator 500 through the second insulation member 450 may be prevented. Thus, the cold air generated in the second evaporator 500 may be entirely used to cool the air passing through the heat-exchange space 460, and thus, the air flowing for cooling the inside of the refrigerator may be effectively cooled.

Radiation layers 441 and 452 may be disposed between the first insulation member 440 and the second insulation member 450. The radiation layers 441 and 452 may be disposed on the inner surface of the heat-exchange space 460, i.e., the entire rear surface of the first insulation member 440 and the entire front surface of the second insulation member 450.

Each of the radiation layers 441 and 452 may be made of a metal material such as aluminum and adhere through a structure such as a thin plate or sheet or formed through various methods applying, coating, deposition, and the like. The cold air generated in the second evaporator 500 may be radiated onto the surfaces of the first insulation member 440 and the second insulation member 450 by the radiation layers 441 and 452 without being permeated into the first insulation member 440 and the second insulation member 450 to further cool the air moving along the inside of the heat-exchange space 460. That is, the cold air generated in the second evaporator 500 may entirely flow to the inside of the heat-exchange space 460 without being lost through the first insulation member 440 and the second insulation member 450 to cool the air.

Figure 14:
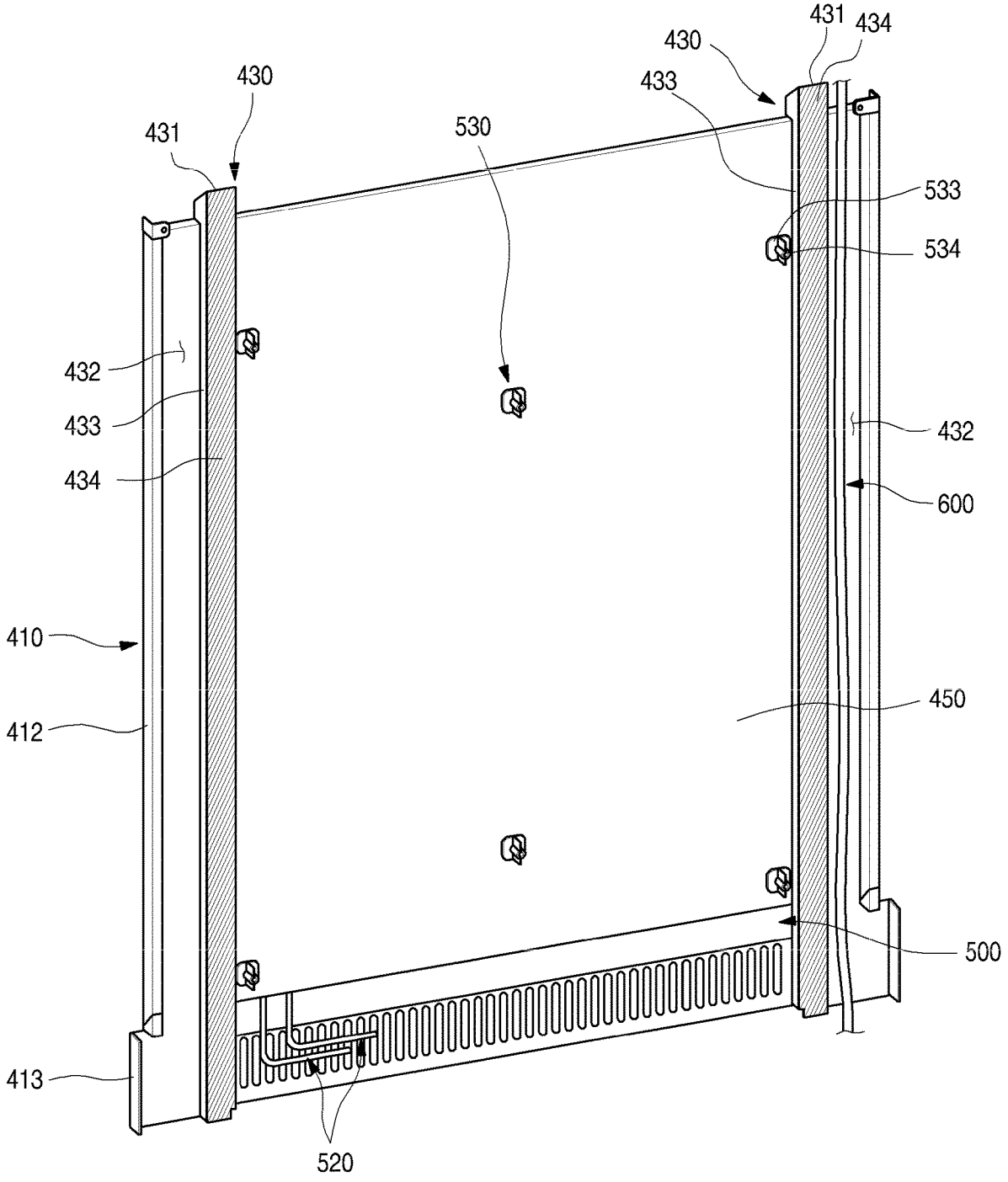
FIG. 14 is a perspective view illustrating a state in which the evaporator cover module and the roll bond evaporator are coupled to each other.
Figure 15:
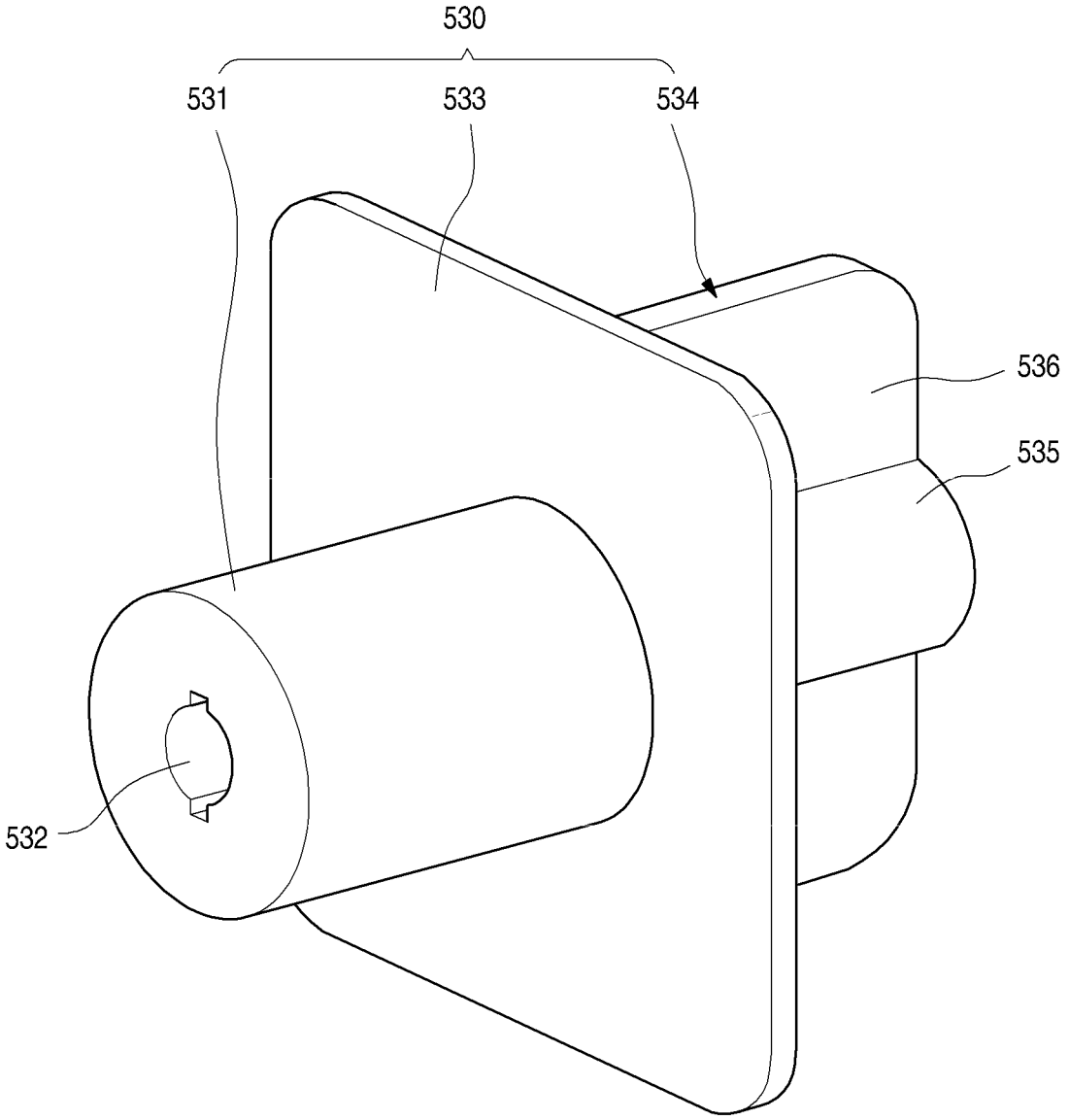
FIG. 15 is a perspective view of an evaporator fixing member according to an embodiment.
Figure 16:
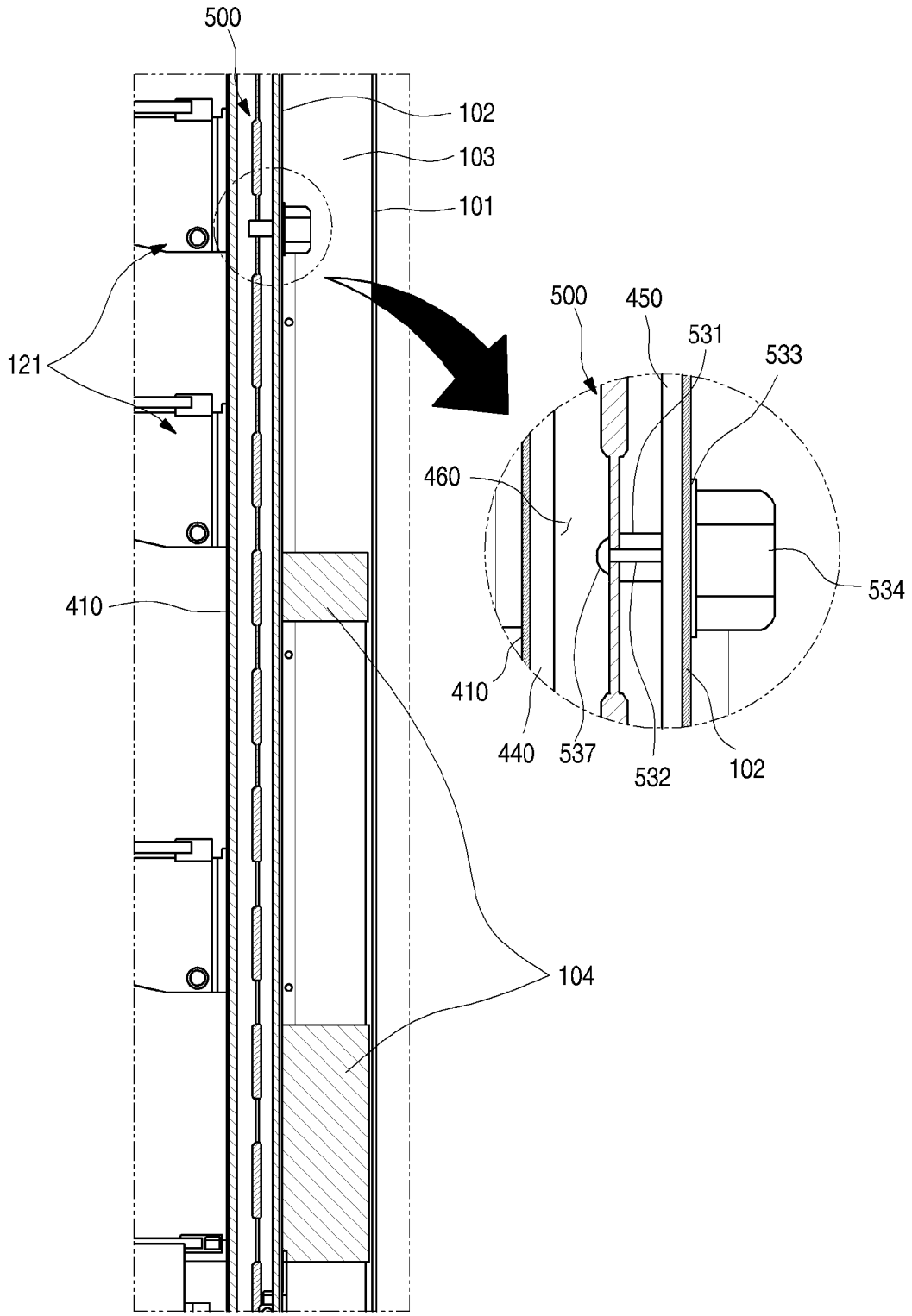
FIG. 16 is an enlarged view of a portion A of FIG. 4.

FIG. 14 is a perspective view illustrating a state in which the evaporator cover module and the roll bond evaporator are coupled to each other. Also, FIG. 15 is a perspective view of the evaporator fixing member according to an embodiment. Also, FIG. 16 is an enlarged view of a portion A of FIG. 4.

As illustrated in the drawings, the evaporator fixing member 530 may be disposed a rear side of the evaporator cover module 400. The evaporator fixing member 530 may be configured so that the second evaporator 500 is fixed and mounted inside the evaporator cover module 400.

The evaporator fixing member 530 may be provided in plurality to wholly fix the second evaporator 500 and maintain a certain distance between the second evaporator 500 and the evaporator cover module 400. The evaporator fixing members 530 may be disposed at upper and lower ends and a center to fix and support the second evaporator 500.

In more detail, as illustrated in FIG. 14, a pair of evaporator fixing members 530 may be disposed on both left and right ends at the upper and lower ends of the second evaporator 500, and a pair of evaporator fixing members 530 may be disposed at the center in a state in which the evaporator fixing members 530 are spaced apart from each other. Thus, the second evaporator 500 may be stably fixed and mounted on an entire surface of the evaporator fixing member 530.

In addition, the second evaporator 500 may be maintained at a predetermined distance inside the heat-exchange space 460 by the evaporator fixing member 530. That is, it may prevent the second evaporator 500 from being changed in position or prevent a distance between an inner wall of the heat-exchange space 460 and the second evaporator 500 from being narrowed by deformation of the evaporator cover module 400 during the assembly process or during the use. Thus, when the second evaporator 500 is defrosted, even though water droplets are generated, the water droplets may not be formed between the second evaporator 500 and the inner wall of the heat-exchange space 460, but flow downward. Also, flow resistance generated when the cold air flows may be prevented from increasing.

It is preferable that a distance between the outer surface of the second evaporator 500 and the heat-exchange space 460 is a distance that is enough to prevent defrost water from being formed by surface tension. The second evaporator 500 may be maintained at a set distance from the inner surface of the heat-exchange space 460 by the evaporator fixing member 530.

The evaporator fixing member 530 may be coupled by passing through the inner case 102 at the rear side of the inner case 102 and may successively pass through the second insulation member 450 and the second evaporator 500. Thus, the second evaporator 500 may be supported on the inner case 102 by the evaporator fixing member 530. Alternatively, the evaporator fixing member 530 may be mounted on the second insulation member 450.

As illustrated in FIG. 15, the evaporator fixing member 530 may include a boss part 531 and a handle 534.

The boss part 531 may define a front portion of the evaporator fixing member 530 and protrude forward from a center of the support plate 533. The boss part 531 may have a length by which the boss part 531 passes through the inner case 102 and the second insulation member 450 to support the second evaporator 500.

Also, a boss hole 335 may be defined in a center of a front surface of the boss part 531, and the screw 537 passing through the evaporator hole 511 may be coupled to a boss part hole 532 to support the second evaporator 500. That is, distances between the second evaporator 500 and the first insulation member 440 and the second insulation member 450 may be adjusted by the extending length of the boss part 531. In this embodiment, the boss part 531 may be disposed so that the second evaporator 500 is disposed at an approximately central portion between the first insulation member 440 and the second insulation member 450.

The support plate 533 may have a plate shape at a rear end of the boss part 531 to extend in a circumferential direction of the boss part 531 and come into surface contact with the inner case 102. The support plate 533 may have various shapes that are capable of coming into surface contact with the inner case 102. In this embodiment, the support plate 533 may have a rectangular plate shape. Thus, when the evaporator fixing member 530 is mounted, the evaporator fixing member 530 may adhere to a rear surface of the inner case 102.

The handle 534 may protrude backward from the center of the support plate 533 and include a handle shaft 535 at the center of the support plate 533 and a handle rib 536 extending upward and downward from an outer surface of the handle shaft 535.

The handle rib 536 may extend from the outer surface of the handle shaft 535 to an outer end of the support plate 533. That is, the handle rib 536 may protrude at a predetermined height so that the user holds the handle rib 536 by using a hand thereof.

The handle 534 may have a structure of the handle rib 536 extending from the protruding handle shaft 535. Thus, the user may hold the handle 534 to insert the handle 534 so that the boss part 531 passes through the inner case 102 and the second insulation member 450, thereby realizing the easy assembly process.

In addition, the handle 534 may be exposed to the space between the inner case 102 and the outer case 101, in which the insulation member 103 is provided. When a foaming solution is injected to mold the insulation member 103, the outer surface of the handle 534 may be buried in the insulation member 103, and thus, the evaporator fixing member 530 may be maintained in the fixed state without being separated.

When the evaporator cover module 400 is mounted, the evaporator cover module 400 may adhere to the rear plate **102*b* by an adhesion member 434 disposed on the rear surface of the duct support part 433 of the side duct 430. Here, at least a portion of the adhesion member 434 may be made of a material having elasticity. Thus, even though the rear plate 102*b* is curved somewhat by the foaming of the insulation member 103, the side duct 430 may adhere to the rear plate 102*b* in a case of being closely attached. Thus, the leakage of the air flowing through the heat-exchange space 460 within the evaporator cover module 400 may be prevented, and also, the evaporator cover module 400 may be more firmly adhered and fixed to the rear plate 102*b***.

Also, in the state in which the evaporator cover module 400 is mounted, the water supply tube 600 may be accommodated in the tube guide part 432 of the side duct 430.

Hereinafter, a flow of the cold air in the refrigerator having the above-described structure according to the current embodiment will be described.

Figure 17:
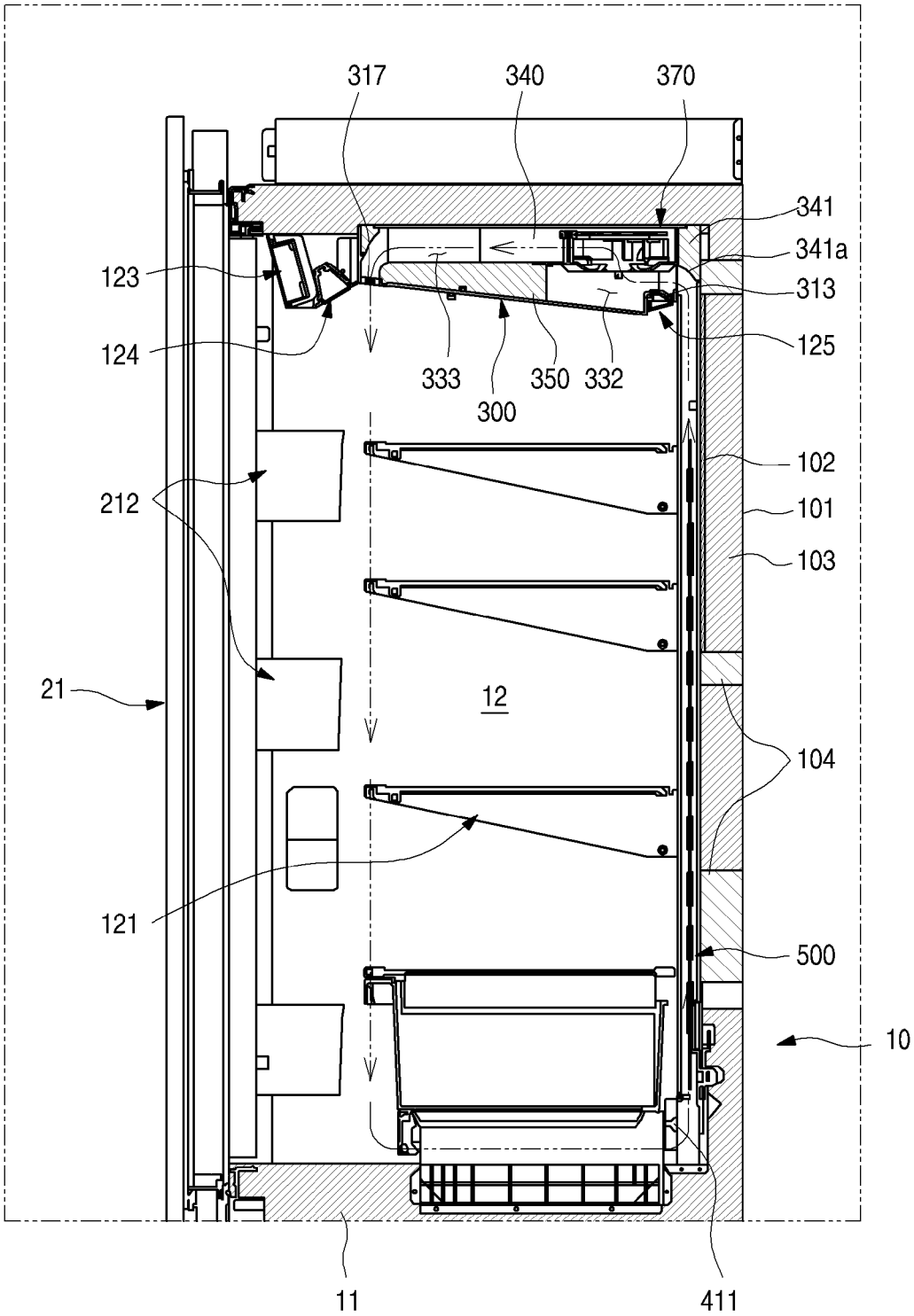
FIG. 17 is a cross-sectional view illustrating a cold air flow state in a refrigerating compartment of the refrigerator.
Figure 18:
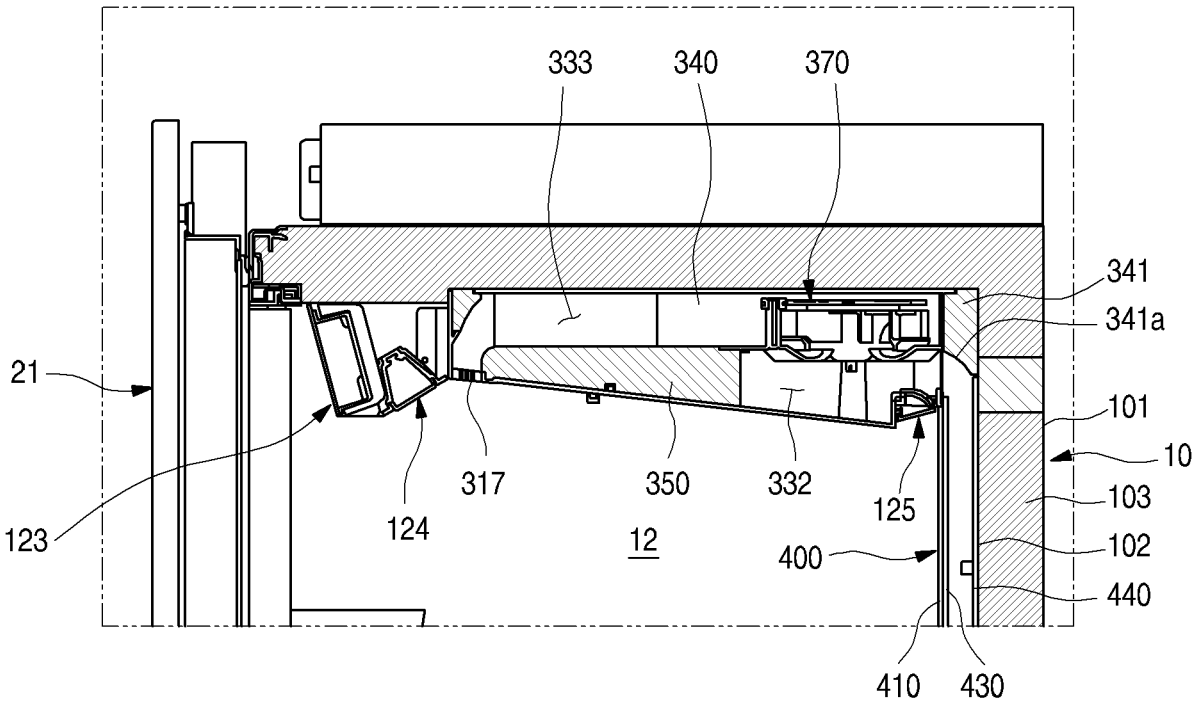
FIG. 18 is a cross-sectional view illustrating a cold air flow state in the evaporator cover module and the cold air supply module.
Figure 19:
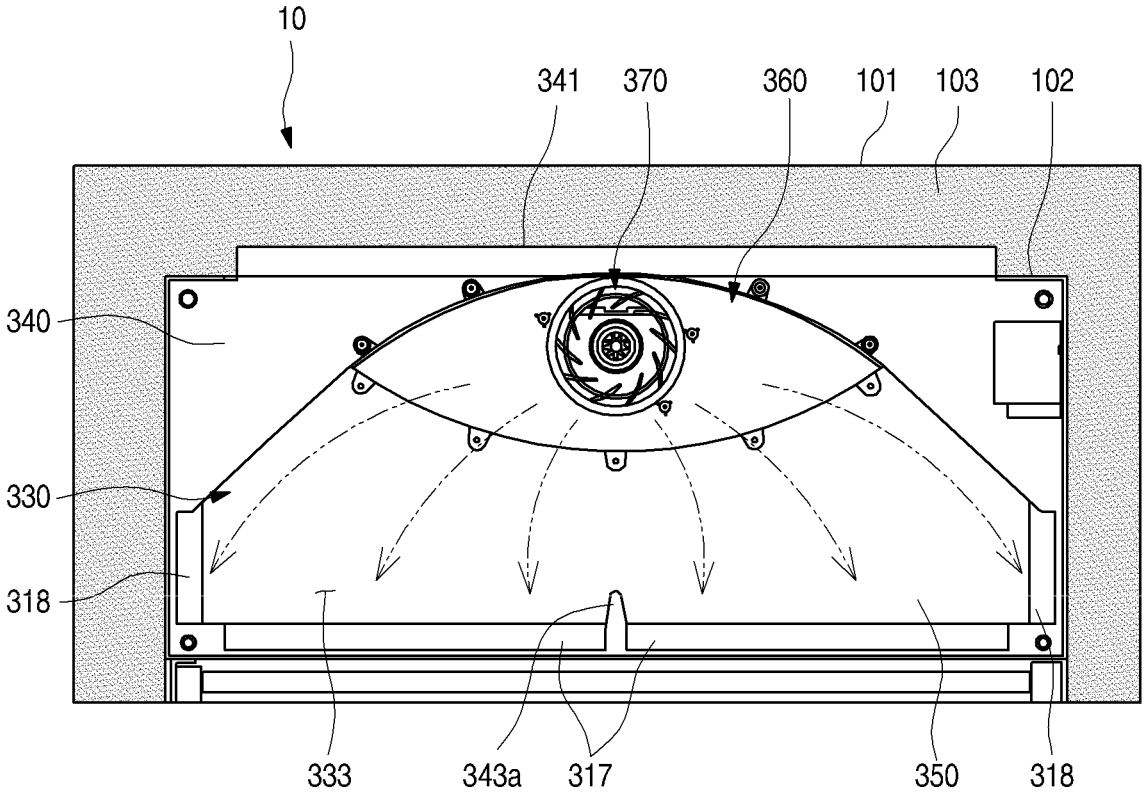
FIG. 19 is a cross-sectional view illustrating a cold air flow state in the cold air supply module.
Figure 20:
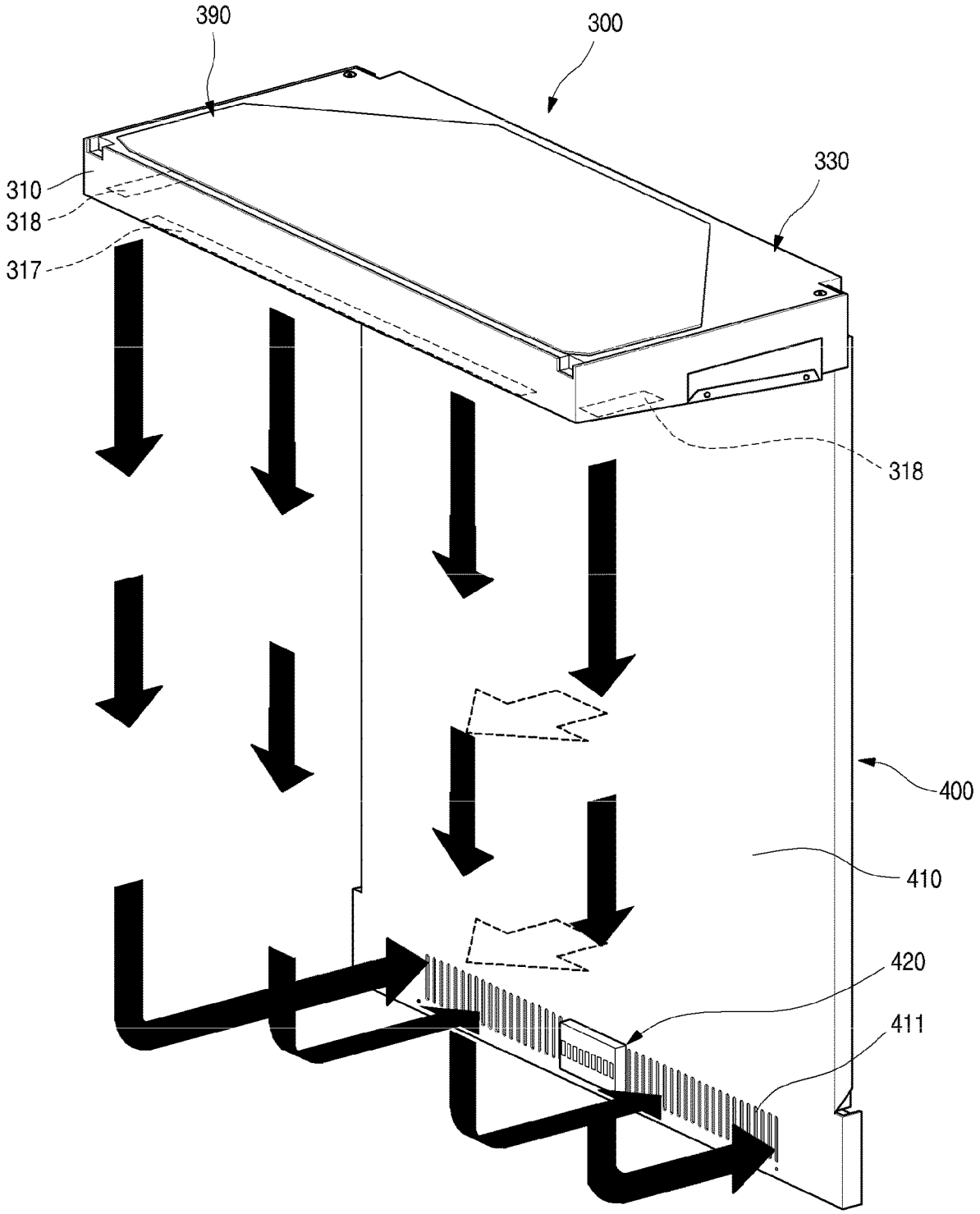
FIG. 20 is a view illustrating a cooling state inside the refrigerating compartment.

FIG. 17 is a cross-sectional view illustrating a cold air flow state in a refrigerating compartment of the refrigerator. Also, FIG. 18 is a cross-sectional view illustrating a cold air flow state in the evaporator cover module and the cold air supply module. Also, FIG. 19 is a cross-sectional view illustrating a cold air flow state in the cold air supply module. Also, FIG. 20 is a view illustrating a cooling state inside the refrigerating compartment.

As illustrated in the drawings, the inside of the storage space of the refrigerator 1 may be cooled to a set temperature by an operation of the refrigeration cycle.

To cool the inside of the refrigerating compartment 12 to a set temperature, the refrigeration cycle including the second compressor 162 and the second evaporator 500 is driven. Also, when the refrigerating compartment blower fan 370 provided in the cold air supply module 300 is driven, a flow of the cooling air within the refrigerating compartment 12 may start to cool the inside of the refrigerator 1.

In detail, when the second compressor 162 is driven, the second evaporator 500 may be in a low-temperature state and also in a state in which cold air is capable of being generated. In this state, when the refrigerating compartment blower fan 370 is driven, the cold air may be suctioned through the evaporator cover module 400 and discharged through the cold air supply module 300. The suction hole 411 of the evaporator cover module 400 may be defined in a lower end area of the refrigerating compartment 12 to suction the cold air existing at the lower portion of the refrigerating compartment 12. Also, the cold air may move upward along the heat-exchange space 460 within the evaporator cover module 400.

Here, the second evaporator 500 is disposed in the heat-exchange space 460, and the cold air is introduced into the cold air supply module 300 after being sufficiently cooled while moving upward along the heat-exchange space 460.

The cold air introduced into the cold air supply module 300 may forcibly flow by the refrigerating compartment blower fan 370 and be discharged downward through the discharge holes 317 and 318 of the cold air supply module 300. Here, the cold air supply module 300 may be disposed on the top surface of the refrigerating compartment 12 to supply the cold air to the lower side of the refrigerating compartment 12.

Also, the front discharge port 317 of the cold air supply module 300 may be disposed on the same extension line between the shelf 121 and the drawer within the refrigerating compartment 12 and the door basket 212 within the refrigerating compartment door 21. Thus, the cold air discharged by the cold air supply module 300 may flow to face the bottom of the refrigerating compartment 12 without being blocked by the accommodation members disposed on the refrigerating compartment 12 and the refrigerating compartment door or the foods accommodated in the accommodation members.

Thus, the cold air within the refrigerating compartment 12 may move upward through the rear surface of the refrigerating compartment 12 from the bottom of the refrigerating compartment 12 and then move forward from the upper end of the refrigerating compartment 12 so as to move again toward the bottom of the refrigerating compartment 12 to circulate. The whole cooling within the refrigerating compartment 12 may be enabled through the above-described process.

A cold air flow state in an upper region of the refrigerating compartment 12 will be described in more detail with reference to FIG. 18. Since the upper end of the evaporator cover module 400 is coupled to the lower end of the cold air supply module 300, the cold air flowing upward within the heat-exchange space 460 may be introduced into the cold air supply module 300 through the inlet part 341.

The cold air passing through the upper end of the evaporator cover module 400 may be introduced into the lower passage 332 within the cold air supply module 300 through the inlet part 341. Here, the guide surface 341*a* may be disposed on the inner surface of the inlet part 341 communicating with the lower passage 332. The guide surface 341*a* may have a rounded curved shape and be connected to the lower passage 332 disposed parallel to the upper end, which extends and is opened in the vertical direction. Thus, the cold air flowing upward through the evaporator cover module 400 may be smoothly introduced into the cold air supply module 300.

Also, a lighting device mounting part 313 on which the lighting device 125 is mounted may be disposed on the lower case 110 in a direction facing the guide surface 341*a*. The lighting device mounting part 313 may be recessed to have a curved surface at a position corresponding to the guide surface 341*a* to more smoothly guide the introduction of the cold air together with the guide surface 341*a*.

The lower passage 332 may be a space between the upper part 340 of the passage formation part 330 and the lower case 310 and define a lower space of the refrigerating compartment blower fan 370. Thus, the cold air introduced through the inlet part 341 may flow to the inside of the refrigerating compartment blower fan 370 from the lower side of the refrigerating compartment blower fan 370.

The refrigerating compartment blower fan 370 may be a centrifugal fan that suctions air in a central direction to discharge the air in a circumferential direction. A fan having a high air volume such as a turbo fan may be used as the refrigerating compartment blower fan 370. Here, the rotation shaft of the refrigerating compartment blower fan 370 may be vertically disposed, and the bottom surface of the refrigerating compartment blower fan 370 may be disposed in parallel to the top surface of the refrigerating compartment to minimize the installation space.

The air suctioned in the shaft direction may be discharged in the circumferential direction by the rotation of the refrigerating compartment blower fan 370 and then move forward along the upper passage 333 and discharged downward through the discharge ports 317 and 318.

The cold air flow within the cold air supply module 300 will be described in more detail with reference to FIG. 17. The cold air suctioned in the shaft direction of the refrigerating compartment blower fan 370 by the rotation of the refrigerating compartment blower fan 370 may be discharged in the circumferential direction.

Here, a portion of the cold air blown by the refrigerating compartment blower fan 370 may flow along the discharge guide surface 342 to flow to the side discharge port 318 along the discharge guide surface 342. Also, the remaining cold air blown by the refrigerating compartment blower fan 370 may flow forward along the upper passage 333 to flow to the front discharge port 317. That is, the cold air discharged in the circumferential direction of the refrigerating compartment blower fan 370 may flow along the upper passage 333 and then be discharged through the front discharge port 317 and the side discharge ports 318.

As illustrated in FIG. 20, in the flow of the cold air for cooling the inside of the refrigerating compartment 12, the cold air suctioned through the suction hole 411 from the lower end of the refrigerating compartment 12 may flow upward along the heat-exchange space 460 within the evaporator cover module 400. Also, the cold air introduced into the cold air supply module 300 from the upper end of the heat-exchange space 460 may flow to the side discharge ports 318 and the front discharge port 317 through the upper passage 333 by the operation of the refrigerating compartment blower fan 370.

The front discharge port 317 and the side discharge ports 318 may be disposed at the front end of the top surface and both side surfaces of the front portion of the refrigerating compartment 12 to discharge the cold air to the inside of the refrigerating compartment 12. Also, the cold air discharged downward may flow again to the suction hole 411 from the lower end of the refrigerating compartment 12.

As described above, the cold air discharged from the front discharge port 317 and the side discharge ports 318 may flow downward along the front end and both side ends of the refrigerating compartment 12 to define a wall of the cold air and thereby to three-dimensionally cool the whole inside of the refrigerating compartment 12.

Particularly, most of the cold air generated in the second evaporator 500, which is covered by the evaporator cover module 400, may be blocked by the first insulation member 440, but a portion of the cold air may be transferred to the outside via the first insulation member 440. Thus, the rear wall of the refrigerating compartment 12 may not be in an extremely low-temperature state such as the temperature of the second evaporator 500. However, the cold air having an adequate temperature that is necessary for cooling the refrigerating compartment 12 may directly cool the rear wall of the refrigerating compartment 12 via the first insulation member 440.

Therefore, as illustrated in FIG. 20, the rear surface as well as the top surface, the bottom surface, the front surface, and the left and right surfaces of the refrigerating compartment 12 may be cooled to three-dimensionally cool the entire inner surfaces of the refrigerating compartment 12.

Hereinafter, a structure in which water is supplied to an ice maker and a dispenser of the refrigerator according to an embodiment will be described.

Figure 21:
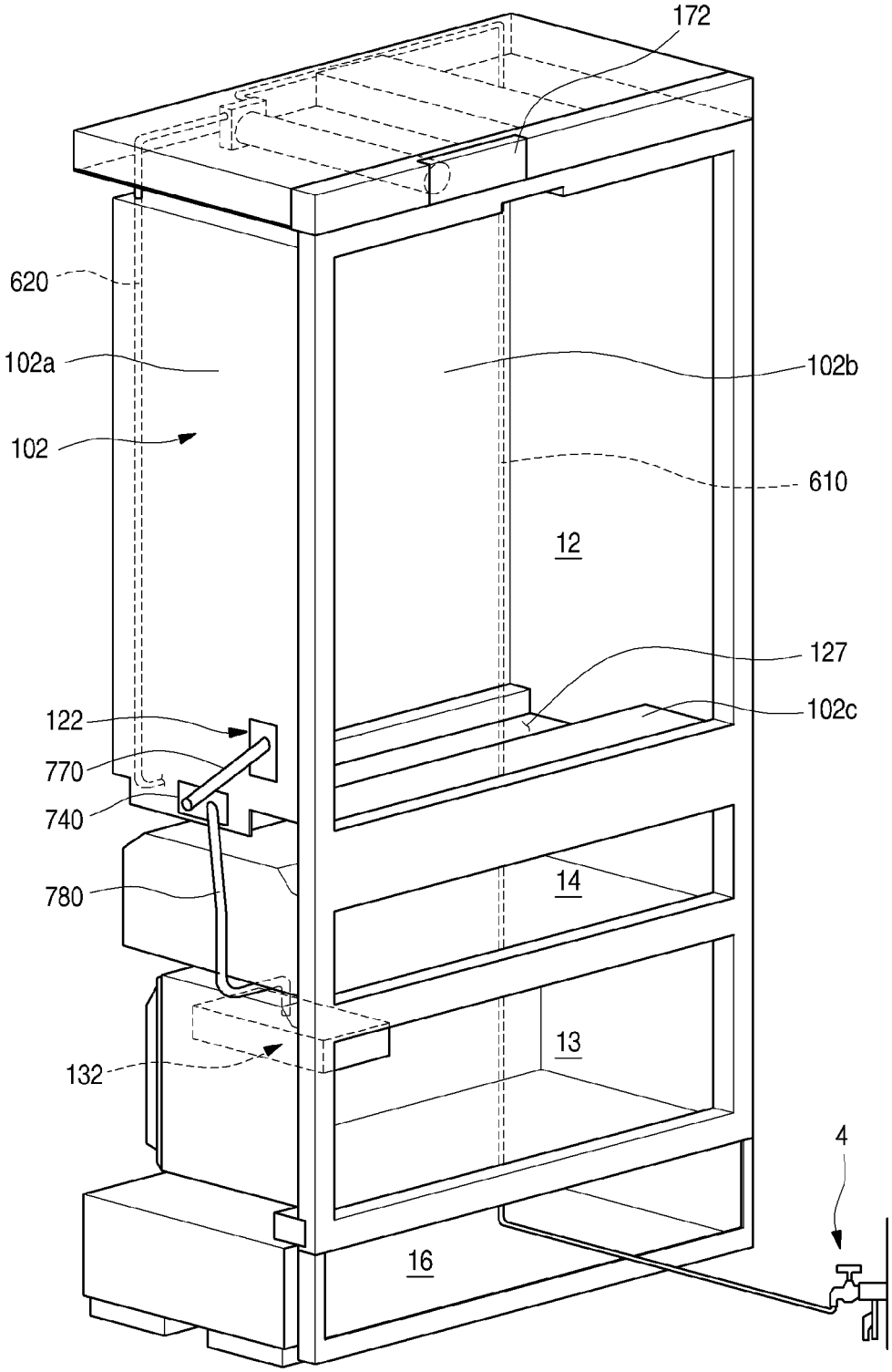
FIG. 21 is a perspective view illustrating an arrangement of a water supply tube of the refrigerator.

FIG. 21 is a perspective view illustrating an arrangement of the water supply tube of the refrigerator.

As illustrated in the drawing, the dispenser 122 may be disposed in the refrigerating compartment 12 so that the user dispenses purified water through a nozzle 122*a* exposed to the inside of the refrigerator. The dispenser 122 may be provided on the wall of one surface of both surfaces of the inner surface. That is, the dispenser 122 may be mounted on one side of the side plate.

Also, an ice maker 132 may be disposed inside the freezing compartment 13. The ice maker may be provided as an auto ice maker that is capable of receiving water that is automatically supplied to make ice.

Also, a main controller 18 may be disposed on the top surface of the cabinet 10. The main controller 18 may be configured to control an overall operation of the refrigerator 1. The main controller 18 may control valves 720, 730, and 750 for supplying water to the dispenser 122 and the ice maker 132 as well as the refrigeration cycle of the refrigerator 1.

A filter 17 may be disposed in the cabinet 10. The filter 17 may be disposed inside or outside the cabinet 10. The filter 17 may be disposed on a top surface of the outside of the cabinet 10 in consideration of convenience of the tube connection and installation environments of the built-in type refrigerator 1. The filter 17 may be covered by an openable filter cover 172. The filter 17 may be mounted to be exchangeable after the filter cover 172 is opened, the filter 17. Also, the filter 17 may be detached from a filter head 171 connected to the water supply tube 600. Purified water may be supplied by the filter 17 connected to the filter head 171.

A water tank 700 may be disposed inside the refrigerating compartment 12. The water tank 700 is configured to store the purified water. The water tank 700 may be connected to the dispenser 122 to supply cold water to the dispenser 122. The water tank 700 may store water to allow a predetermined amount of water to be taken out seven times to eight times. Here, the water may be stored in a state of being cooled by the cold air within the refrigerating compartment 12. Thus, when the user manipulates the dispenser 122, the water that is always cooled may be dispensed.

The water supply tube 600 for supplying water to the refrigerator 1 may include a water inlet tube 610 extending from a water supply source 4 of the outside of the refrigerator to the inside of the cabinet 10 and connected to the filter head 171, a water outlet tube 620 disposed from the filter head 171 to the water tank 700, a dispenser tube 630 disposed from the water tank 700 to the dispenser 122, and an ice maker tube 640 disposed from the water tank 700 to the ice maker 132.

The water inlet tube 610 may be connected to the water supply source 4 such as a water supply system and be guided to the inside of the cabinet 10 through the rear surface of the cabinet 10 or the inside of the machine room 16. Here, the water inlet tube 610 may pass through the outer case 101 and the inner case 102. The water inlet tube 610 may pass through a water inlet tube guide pipe 760 disposed to be protected from the insulation member 103 to extend up to the top surface of the cabinet 10. As necessary, the water inlet tube 610 may be guided up to the top surface of the cabinet 10 from the inside of the machine room 16 to the outside of the cabinet 10.

Although not shown in detail, a water inlet valve 750 that is guided upward within the machine room 16 and opened and closed according to supply of water from the water supply source 4 may be connected to the water inlet tube 610.

An end of the water inlet tube 610 is connected to the filter head 171. In the state in which the filter 17 is mounted on the filter head 171, water supplied by the water inlet tube 610 may be supplied into the filter 17 and thus be purified.

The water purified in the filter 17 may be introduced again into the water outlet tube 620 through the filter head 171. All the filter 17 and the filter head 171 may be disposed on the top surface of the cabinet 19. Thus, the water inlet tube 610 and the water outlet tube 620 may be disposed to extend to the top surface of the outside of the cabinet 10.

The water outlet tube 620 may pass through the top surface of the inner case 102 and then be introduced into the refrigerating compartment 12. Here, the water outlet tube 620 may be guided downward along a tube guide part 432 provided in the side duct 430 of the evaporator cover module 400. The water outlet tube 620 may be guided from the upper end to the lower end of the refrigerating compartment 12 along the guide duct 430. Thus, the water outlet tube 620 may substantially pass through the inside of the refrigerating compartment 12 to perform primary cooling by the cold air of the refrigerating compartment 12.

Also, the water outlet tube 620 may be branched from the bottom surface of the refrigerating compartment 12. Thus, the branched one tube of the water outlet tube 620 may be successively connected to the water tank 700 and the dispenser 122, and the other tube may be connected to the ice maker 132. The connection structure of the water supply tube 600 on the bottom surface of the refrigerating compartment 12 will be described below in detail.

The dispenser tube 630 may pass through the sidewall of the refrigerating compartment 12, i.e., the side plate 102*a* to extend up to the dispenser 122 along the outside of the inner case 102. Here, since the dispenser tube 630 passes through the space between the outer case 101 and the inner case 102, in which the insulation member is disposed, the dispenser tube 630 may pass through the dispenser tube guide pipe 770 disposed on the outer surface of the inner case 102 to lead to the dispenser 122. The dispenser tube guide pipe 770 may be disposed to allow both ends thereof to communicate with a dispenser tube hole 741 defined in the side plate 102*a* and the dispenser 122 disposed on the side plate 102*a*.

Thus, the dispenser tube 630 connected to the dispenser 122 may have a structure that passes through the side plate 102*a* and then is connected to the dispenser 122 via the outside of the inner case 102. Thus, the connection of the tubes of the dispenser 122 may be easily performed inside the inner case 102.

The ice maker tube 640 may pass through the sidewall of the refrigerating compartment 12, i.e., the side plate 102*a* to extend up to the ice maker 132 along the outside of the inner case 102. Here, since the ice maker tube 640 passes through the space between the outer case 101 and the inner case 102, in which insulation member is disposed, the ice maker tube 640 may pass through the ice maker tube guide pipe 780 disposed on the outer surface of the inner case 102 to lead to the ice maker 132. The ice maker tube guide pipe 780 may be disposed to allow both ends thereof to communicate with an ice maker tube hole 742 defined in the side plate 102*a* and the side to top surface of the inner case 102 defining the inner surface of the freezing compartment 13.

Thus, the ice maker tube 640 connected to the ice maker 132 may have a structure that passes through the side plate 102*a* and then is connected to the ice maker 132 disposed inside the freezing compartment 13 via the outside of the inner case 102. Thus, the tube connection between the water tank 700 inside the refrigerating compartment 12 and the ice maker 132 inside the freezing compartment 13 may be easily performed.

Hereinafter, the connection structure of the water supply tube 600 inside the refrigerating compartment 12 will be described below in detail with reference to the drawings.

Figure 22:
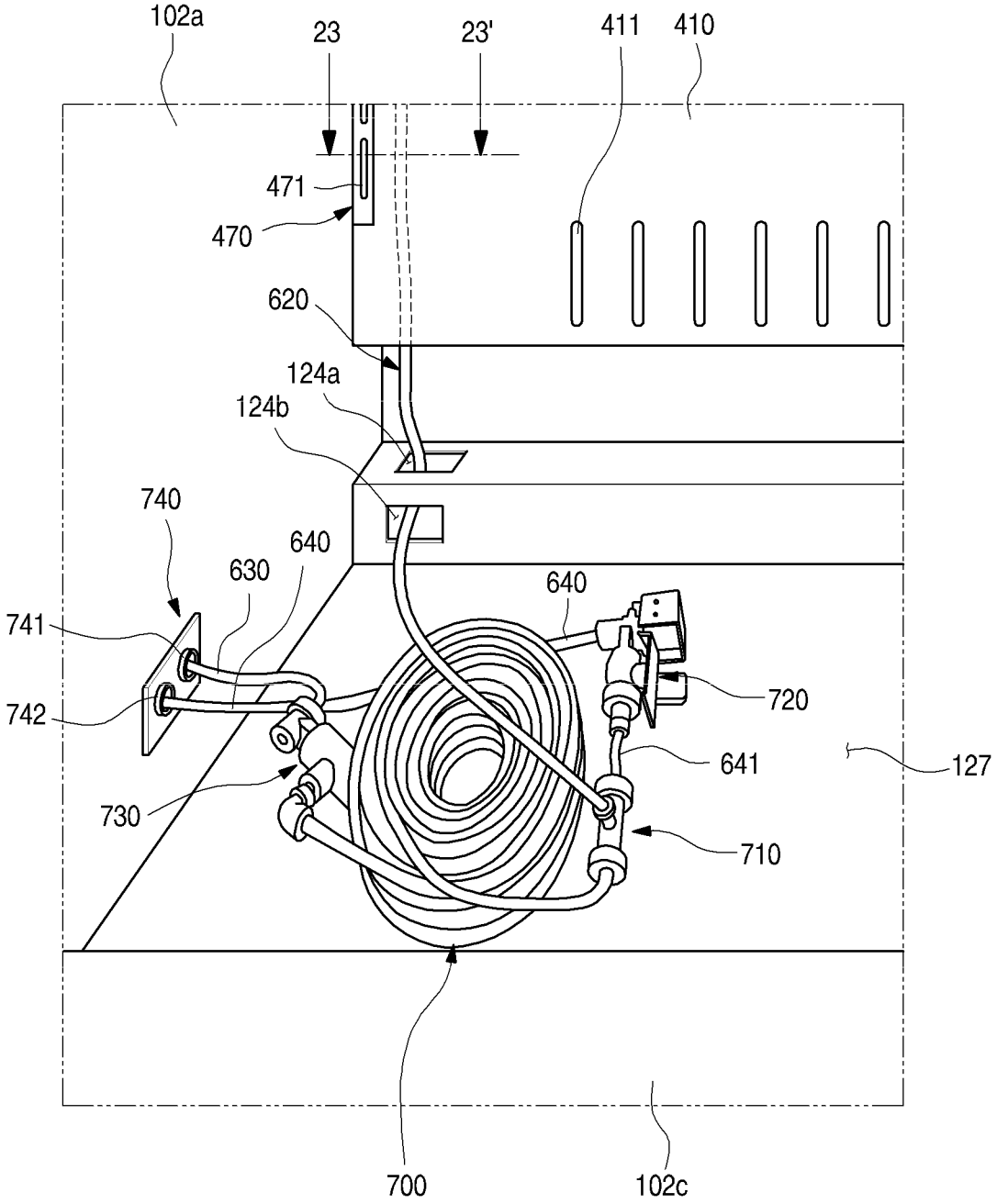
FIG. 22 is a partial perspective view illustrating an arrangement and a connection structure of a water tank according to an embodiment.
Figure 23:
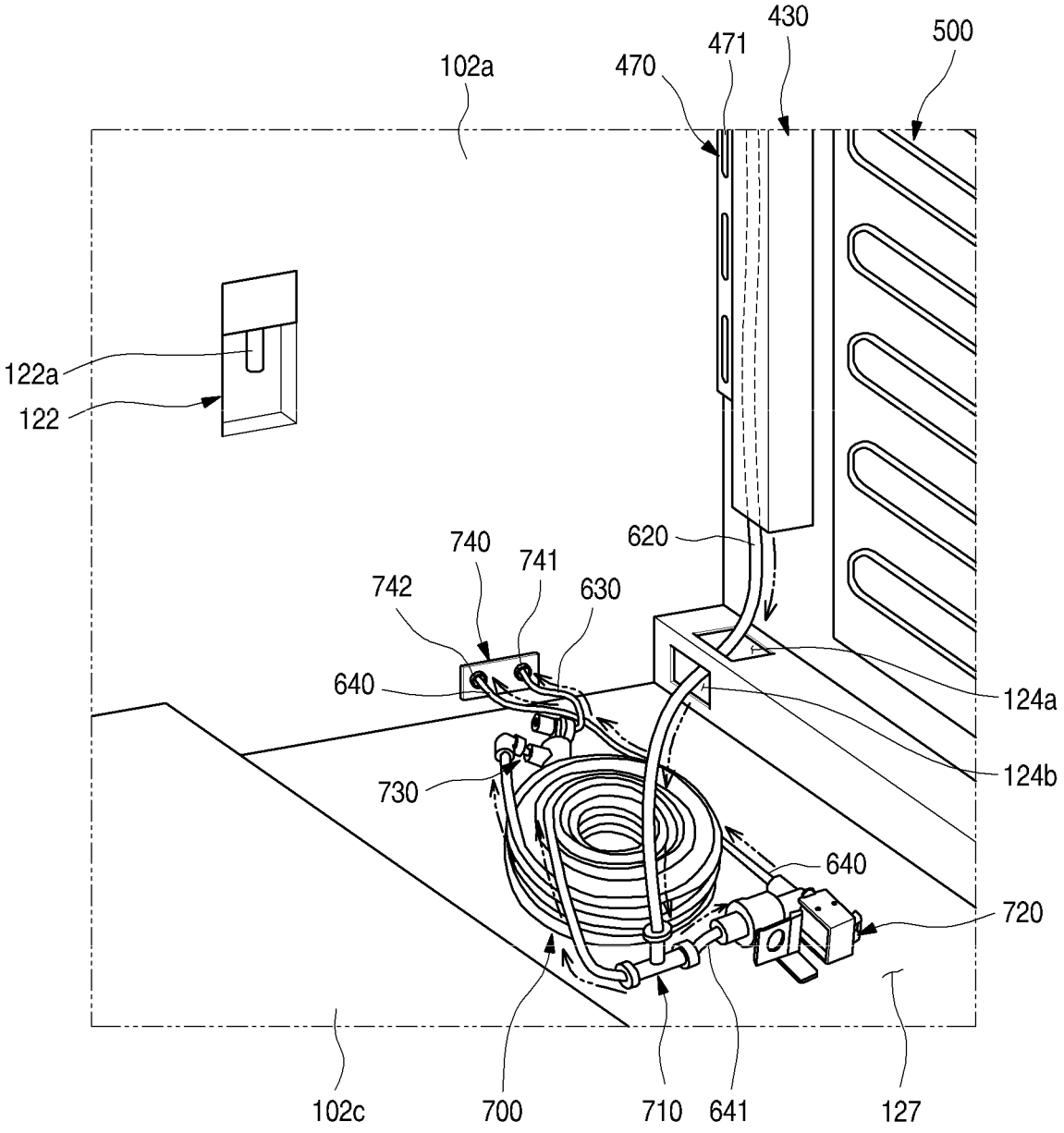
FIG. 23 is a partial perspective view illustrating a state in which a rear plate is removed in FIG. 22.
Figure 24:
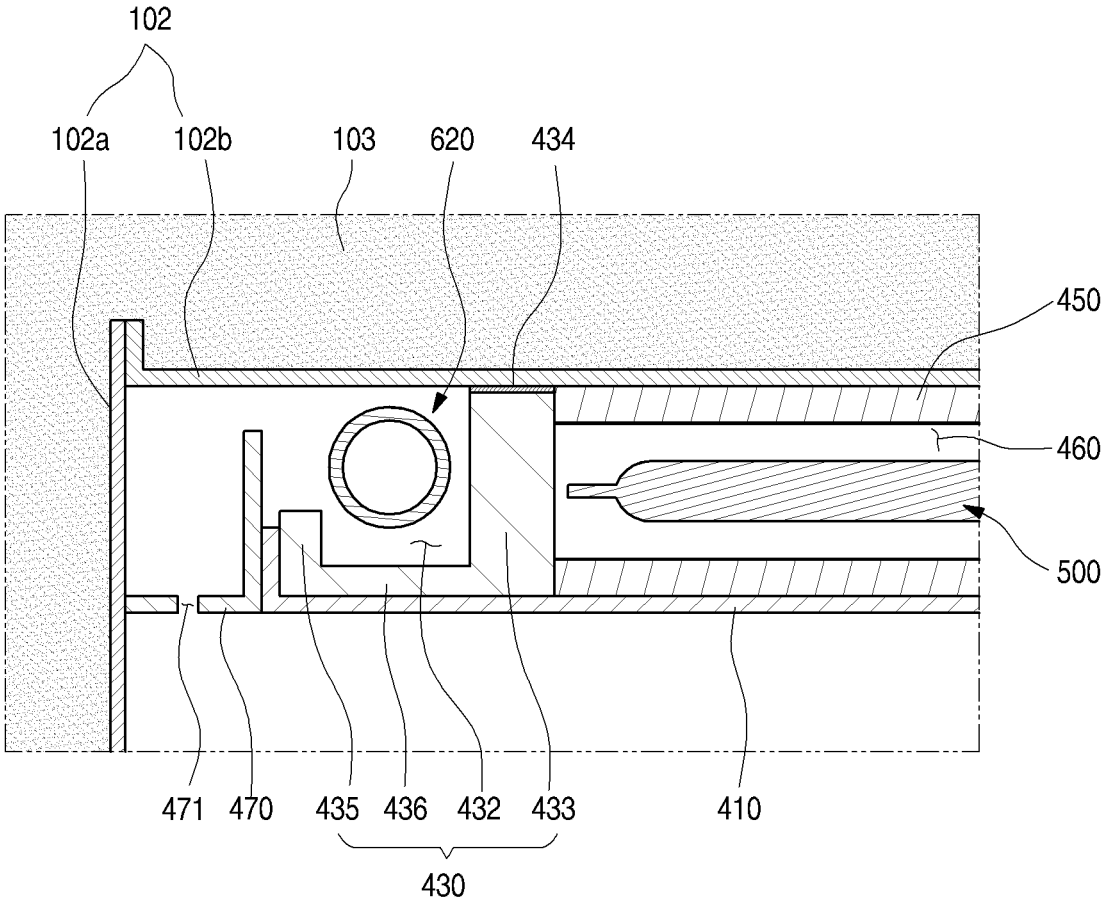
FIG. 24 is a cross-sectional view taken along line 23-23' of FIG. 22.

FIG. 22 is a partial perspective view illustrating an arrangement and a connection structure of a water tank according to an embodiment. Also, FIG. 23 is a partial perspective view illustrating a state in which the rear plate is removed in FIG. 22. FIG. 5 is a cross-sectional view taken along line 23-23' of FIG. 22.

As illustrated in the drawings, the rear wall of the refrigerating compartment 12 may be defined by the evaporator cover module 400 and cooled by the second evaporator 500 provided in the evaporator cover module 400.

Also, the side ducts 430 may be disposed on both the ends of the evaporator cover module 400, and the water outlet tube 620 constituting the water supply tube 600 may be guided through the side ducts 430.

The side ducts 430 include a duct support part 433 and a duct bent part 435, which are disposed on both sides to provide the tube guide part 432 for guiding the water outlet tube 620 and a duct front part 436 connecting front ends of the duct support part 433 and the duct bent part 435 to each other.

Here, the duct support part 433 may have a thickness greater than that of the water outlet tube 620. Also, the duct support part 433 may extend to be enough to define the heat-exchange space 460 and adhere to the rear plate 102*b* by the adhesion member 434. Also, the duct support part 433 may have a sufficient thickness to prevent the cold air of the second evaporator 500 from being permeated into the tube guide part.

The duct bent part 435 may come into contact with the bent parts 412 and 413 of the rear plate 410. Also, as necessary, the duct bent part 435 may extend backward to come into contact with the rear plate 102*b*.

The duct front part 436 may connect the duct support part 433 to the duct bent part 435 and be closely attached to the rear surface of the rear plate 410. Here, the duct front part 436 may have a thickness less than that of each of the duct bent part 435 and the duct support part 433, i.e., a thickness corresponding to the first insulation member 440. The tube guide part 432 in which the water outlet tube 620 is disposed to be spaced apart from the rear plate 102*b* may be disposed inside the guide duct 430 by the duct front part 436.

That is, the water outlet tube 620 may be disposed inside the side ducts 430 and may not be directly affected by the second evaporator 500 due to the duct support part 433 having the relatively thick thickness. Also, the water outlet tube 620 may be primarily cooled by the cold water introduced into the duct front part 436 having the relatively thin thickness or the tube guide part 432 so that the water within the water outlet tube 620 is cooled at a proper temperature.

A recess part 127 that is recessed may be defined in the bottom surface of the refrigerating compartment 12. The recess part 127 may provide a space in which the water tank 700, the valves 720 and 730 connected to the water tank 700, and a portion of the tubes constituting the water supply tube 600 are accommodated. The bottom plate 102*c* may be bent several times to define the recess part 127.

The recess part 127 may define the bottom surface of the refrigerating compartment 12. Thus, at least a portion of the recess part 127 may be covered by the accommodation member such as the drawer 128 disposed on the bottom surface of the refrigerating compartment 12. Also, in the structure in which the drawer 128 is not provided, the recess part 127 may be covered by a separate plate-shaped cover.

Also, the recess part 127 may be defined in the front of the suction hole 411. Thus, the recess part 127 may be disposed on the flow path of the cold air suctioned into the suction hole 411. As a result, the water tank 700 provided in the recess part 127 may be cooled by the cold air suctioned into the suction hole 411. That is, the water stored in the water tank 700 may be stored in the state cooled at substantially the same temperature of the refrigerating compartment 12.

The water tank 700 may be provided in a reel or coil shape in which the tubs is wound several times. Due to this structure, the introduced water may be discharged first after being cooled. Thus, the cooling performance of the water discharged to the dispenser 122 may be secured, and also, contamination of the water stagnant in the water tank 700 may be fundamentally prevented. The water tank 700 may have an appropriate length according to a storage amount of required water and have a structure that is repeatedly wound in a circular shape.

A first opening 124*a* and a second opening 124*b* may be defined in a rear end of the recess part 127. The first opening 124*a* may be disposed directly below the side duct 430 outside the recess part 127, and the second opening 124*b* may be disposed inside the recess part 127 to communicate with the first opening 124*a*. Thus, the water outlet tube 620 guided downward through the side duct 430 may be guided into the recess part 127.

Also, a branch connector 710 may be disposed on an end of the water outlet tube 620. The branch connector 710 may be connected to the water tank 700 and the ice maker valve 720. That is, the water supplied through the water outlet tube 620 may be supplied to the water tank 700 and the ice maker valve 720 by the branch connector 710.

The branch connector 710 and the water tank 700 may be directly connected to each other. Thus, the water supplied to the water tank 700 through the water outlet tube 620 may be stored in the water tank 700 and then cooled.

Also, the branch connector 710 and the ice maker valve 720 may be connected to each other through the connection tube 641. Thus, the water supplied to the ice maker valve 720 through the water outlet tube 620 may be supplied by the connection tube 641.

The ice maker valve 720 may be opened and closed to supply water to the ice maker 132. The ice maker valve 720 may control a flow rate for supplying a set amount of water. A pump may be added to effectively supply the water to the ice maker 132.

The ice maker tube 640 may be connected to an outlet of the ice maker valve 720. The ice maker tube 640 may pass through an ice maker tube hole 742 defined in the side plate 102*a* and then be inserted into the ice maker tube guide pipe 780. Also, the ice maker tube 640 may be introduced into the freezing compartment 12, in which the ice maker is disposed, through the ice maker tube guide pipe 780 and then connected to the ice maker 132. That is, the ice maker tube 640 may have a structure in which the ice maker tube 640 is inserted through the ice maker tube guide pipe 780 and has one end connected to the ice maker 132 and the other end connected to the ice maker valve 720.

Also, a dispenser valve 730 may be disposed on the outlet of the water tank 700. The dispenser valve 730 may be opened and closed to supply water to the dispenser 122. The dispenser valve 720 may detect a flow rate of water to be supplied and control supply of water according to the flow rate, and a water pump may be added to effectively supply the water to the dispenser 122.

The dispenser tube 630 may be connected to an outlet of the dispenser valve 730. The dispenser tube 630 may pass through a dispenser tube hole 741 defined in the side plate 102*a* and then be inserted into the dispenser tube guide pipe 770. Also, the dispenser tube 630 may be guided to the dispenser 122 through the dispenser tube guide pipe 770 and be connected to the dispenser 122. That is, the dispenser tube 630 may have a structure in which the dispenser tube 630 is inserted through the dispenser tube guide pipe 770 and has one end connected to the dispenser 122 and the other end connected to the dispenser valve 730.

The ice maker tube hole 742 and the dispenser tube hole 741 may be defined in a hole bracket 740 mounted on the side plate 102*a*. The hole bracket 740 may be injection-molded and mounted on the side plate 102*a*. Also, an outer surface of the hole bracket 740 may be connected to the ice maker tube guide pipe 780 and the dispenser tube guide pipe 770. Thus, when the ice maker tube 640 and the dispenser tube 630 are inserted into the ice maker tube hole 742 and the dispenser tube hole 741, the ice maker tube 640 and the dispenser tube 630 may be smoothly guided to the ice maker 132 and the dispenser 122 along the ice maker tube guide pipe 780 and the dispenser tube guide pipe 770.

Hereinafter, a water supply process in the refrigerator according to an embodiment will be described in detail with reference to the drawing.

Figure 25:
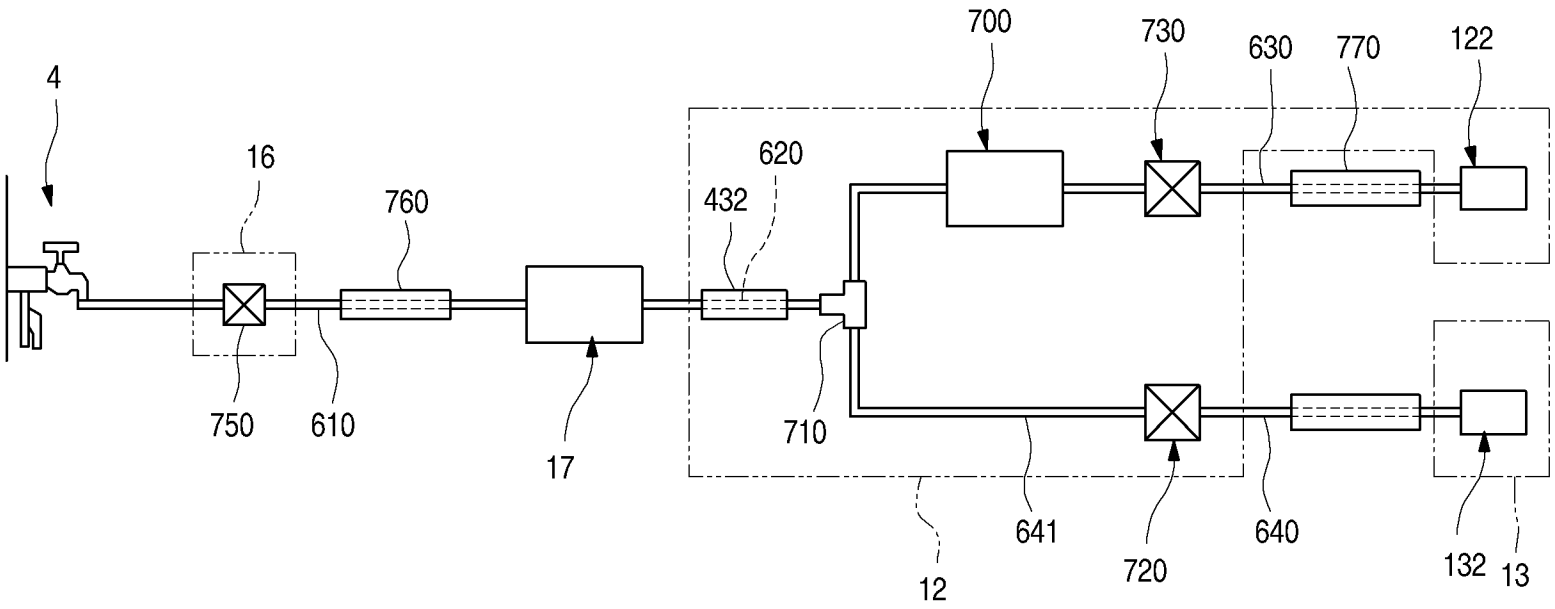
FIG. 25 is a schematic view illustrating an entire water supply path of the refrigerator.

FIG. 25 is a schematic view illustrating an entire water supply path of the refrigerator.

As illustrated in the drawing, water supplied through the water supply source 4 is guided to the inside of the machine room 16 through the water inlet tube 610. The water inlet valve 750 may be disposed in a water inlet tube 610 within the machine room 16. The water introduced through the water inlet valve 750 may be adjusted to be maintained to a set pressure.

The water outlet tube 610 may be guided up to the top surface of the cabinet 10 through an inlet tube guide pipe 760. The inlet tube 610 may communicate with the filter 17 on the top surface of the cabinet 10. The water supplied to the filter 17 through the water inlet tube 610 may be purified by the filter 17, and the purified water may be introduced into the refrigerating compartment 12 through the water outlet tube 620.

Here, the water outlet tube 620 may be guided from the upper end to the lower end of the refrigerating compartment 12 through the side ducts 430 disposed on both the sides of the evaporator cover module 400. Thus, the water passing through the water outlet tube 620 may be primarily cooled by the cold air within the space of the refrigerating compartment 12.

The water outlet tube 620 may extend up to the inside of the recess part 127 of the refrigerating compartment 12 and be branched into the ice maker valve 720 and the water tank 700 by the branch connector 710. The branch connector 710 may have one side connected to the ice maker valve 720 by the connection tube 641 to supply water to the ice maker valve 720. Also, the other side of the branch connector 710 may be connected to the water tank 700 to always store and cool a set amount of water in the water tank 700.

Also, when a signal for supplying water to the ice maker 132 occurs, the ice maker valve 720 may be opened to supply a set amount of water to the ice maker 132 through the ice maker tube 640, thereby making ice.

Also, when a signal for supplying water to the dispenser 122 occurs, the dispenser valve 730 may be opened to supply cooled water to the dispenser 122 through the dispenser tube 630 so that the user dispenses a desired amount of water.

The following effects may be expected in the refrigerator according to the proposed embodiments.

The entire inner case defining the inside of the refrigerator may be made of the metal material so that the refrigerator is manufactured with the more simple structure, and also, the outer appearance of the refrigerator may be more elegant.

However, in the above-described structure, when the roll bond type evaporator is disposed on the rear wall surface within the refrigerator, the cold air may not be transferred to the storage space but be transferred to the rear wall surface of the inner case to deteriorate the cooling performance. Thus, the cold air transferred backward may be blocked by the plate-shaped insulation member disposed on the evaporator cover module to prevent the heat loss from occurring and also prevent the cooling efficiency from being deteriorated.

Particularly, since the roll bond type evaporator in addition to the cold air supply module is disposed on the rear wall, the wall of the cold air may be defined on the entire surface of the refrigerating compartment. Thus, the penetration of the heat load may be prevented, and also, the inside of the refrigerator may be three-dimensionally cooled.

Also, a radiation layer may be disposed on the rear surface and the front surface of the first insulation member and the second insulation member, which are disposed at front and rear sides with the evaporator therebetween. The radiation layer may be provided as a metal thin plate or sheet such as aluminum. Thus, the cold air of the evaporator may not be permeated into the insulation member but be radiated onto the surface to minimize the loss of the cold air in the heat-exchange space in which the evaporator is accommodated, thereby maximizing the cooling efficiency.

As described above, since the roll bond type evaporator is disposed, and the heat-exchange space is provided by using the insulation member, the inside of the refrigerating compartment may be independently cooled, and also, the inside of the refrigerator may be uniformly cooled by the cold air.

Also, the roll bond type evaporator may be adopted to secure the space of the rear wall of the refrigerator, thereby increasing in storage capacity.

Also, the side ducts may be disposed on both the ends of the evaporator cover module in which the evaporator is accommodated, and the spaces of both sides of the evaporator may be covered by the side ducts to cool all the air passing through the heat-exchange space by the evaporator, thereby significantly improving the heat-exchange efficiency.

Also, the tube guide part for guiding the water supply tube may be disposed inside the side duct, and the water supply tube may be disposed along the tube guide part to prevent the thickness loss of the insulation member defining the cabinet from occurring.

Thus, the insulation performance of the refrigerator may be improved, and the water supply tube may be disposed in the refrigerator so that the insulation member has a relatively thin thickness to secure the storage space.

Particularly, since the water supply tube is disposed within the side ducts, it may be unnecessary to secure the additional space for locating the water supply tube. Thus, the loss of the storage space due to the arrangement of the water supply tube within the refrigerator may be prevented.

In addition, the arrangement of the water supply tube may be performed together when the evaporator cover module is mounted in the refrigerator to improve the workability and the productivity.

In addition, the water supply tube is disposed in the refrigerator to primarily cool the cold air within the refrigerator, and also, while the water is introduced into the water tank, the water may be cooled to improve the cooling performance of the cold water.

In addition, the structure of the side duct in which the water supply tube is disposed may be partitioned from the evaporator to prevent the water supply tube from being frozen by the evaporator, and the water flowing along the water supply tube may be cooled at the appropriate temperature.

In addition, the water supply tube may be connected to the water tank and the valves within the refrigerator, and the water supply tube may be inserted and withdrawn through the guide pipe attached to the outer surface of the cabinet within the refrigerator to provide the more easy connection structure to the dispenser and the ice maker.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet comprising an outer case that defines an outer appearance of the cabinet and an inner case that is located inside of the outer case and that defines a storage space;

an evaporator located in the storage space;

an evaporator cover module located at the inner case and configured to cover the evaporator, the evaporator cover module defining a surface of the storage space; and a cold air supply module disposed at an upper end of the storage space and configured to communicate with the evaporator cover module, the cold air supply module being configured to supply cold air from the evaporator cover module to the storage space, wherein the evaporator cover module comprises:

a rear plate that has a planar shape and that defines the surface of the storage space, a first insulation member located at a rear surface of the rear plate, a second insulation member spaced apart from the first insulation member and located at a front surface of the inner case, and a pair of side ducts that define side ends of the heat-exchange space and that are located at lateral sides of a rear surface of the rear plate, respectively, wherein the first insulation member, the evaporator, and the second insulation member are located laterally between the pair of side ducts and arranged in a forward-backward direction, wherein the evaporator is accommodated in a heat-exchange space defined by the first insulation member, the second insulation member, and the pair of side ducts, wherein the pair of side ducts comprises a duct coupling part that is inserted into an inside of the cold air supply module and that couples the evaporator cover module to the cold air supply module, and wherein the evaporator cover module is configured to guide upward cold air generated by the evaporator to supply the cold air into the cold air supply module disposed at the upper end of the storage space.

2. The refrigerator according to claim 1, wherein the evaporator is configured to couple to the evaporator cover module in a state in which the evaporator is spaced apart from a surface of the inner case that defines a rear surface of the storage space.

3. The refrigerator according to claim 2, wherein the evaporator is spaced apart from the first insulation member and the second insulation member.

4. The refrigerator according to claim 1, wherein the inner case of the cabinet is made of a metal material, and wherein the inner case comprises a plurality of plates that are coupled to each other and that define one or more surfaces of the storage space.

5. The refrigerator according to claim 1, wherein the evaporator cover module further comprises an evaporator fixing member that is located at a rear surface of the inner case, that is configured to pass through the inner case and the second insulation member to couple to the evaporator, and that is configured to support the evaporator, and wherein the evaporator fixing member is configured to, based on the evaporator fixing member coupling to the evaporator, support the evaporator at a position that is spaced apart from the first insulation member and the second insulation member.

6. The refrigerator according to claim 5, wherein the evaporator fixing member comprises:

a support plate configured to couple to the rear surface of the inner case;

a boss part that extends from the support plate toward the evaporator, that is configured to contact the evaporator, and that is configured to pass through the inner case and the second insulation member; and a coupling member that passes through the evaporator and that is configured to couple to the boss part.

7. The refrigerator according to claim 1, wherein the evaporator cover module further comprises a radiation layer that is made of a metal material, that is located at a surface of each of the first insulation member and the second insulation member, and that is configured to restrict heat transfer from cold air in the heat-exchange space to each of the first insulation member and the second insulation member, and wherein the radiation layer of each of the first insulation member and the second insulation member faces an interior of the heat-exchange space.

8. The refrigerator according to claim 1, wherein the pair of side ducts are made of an insulation material.

9. The refrigerator according to claim 8, wherein the evaporator cover module further comprises an adhesion member that is located at each of the pair of side ducts, that is made of a material having an elasticity, and that is configured to couple to a front surface of the inner case, the adhesion member being configured to seal the heat-exchange space between the pair of side ducts.

10. The refrigerator according to claim 8, further comprising a water supply tube configured to supply water to the refrigerator, wherein each side duct defines a tube guide part that is recessed from a surface of each side duct, that is configured to accommodate the water supply tube, and that extends in a longitudinal direction of each side duct.

11. The refrigerator according to claim 10, wherein the tube guide part defines openings that are located at upper and lower ends of each side duct and that allow the water supply tube to enter the storage space through the tube guide part.

12. The refrigerator according to claim 11, further comprising a filter located at an outer top surface of the cabinet, wherein the water supply tube is configured to connect to the filter, to pass through the cabinet, and to enter the tube guide part.

13. The refrigerator according to claim 10, wherein each side duct comprises:

a duct support part that defines at least a portion of the heat-exchange space and that faces toward a side of the evaporator; and a duct front part that extends from the duct support part and that defines the tube guide part, a thickness of the duct support part being greater than a thickness of the duct front part, and wherein the duct support part is configured to separate the water supply tube from the heat-exchange space and to restrict heat transfer from the evaporator to the water supply tube.

14. The refrigerator according to claim 10, further comprising a water tank configured to receive water from the water supply tube, wherein the cabinet defines a recess part located at a bottom surface of the storage space and configured to accommodate the water tank.

15. The refrigerator according to claim 14, wherein the evaporator cover module defines a suction hole located at a lower end of the evaporator cover module and configured to receive cold air from the storage space, and wherein the recess part is located at a front of the suction hole and is configured to be cooled by cold air that enters the suction hole.

16. The refrigerator according to claim 14, further comprising:

a dispenser located in the storage space and configured to discharge water;

a freezing compartment defined by the cabinet and configured to operate independent of the storage space; and an ice maker located inside of the freezing compartment and configured to generate ice, wherein the water supply tube comprises a plurality of tubes and a plurality of valves connected to the plurality of tubes, respectively, wherein the plurality of tubes include a dispenser tube configured to connect to the dispenser and an ice maker tube configured to connect to the ice maker, and wherein the dispenser tube, the ice maker tube, the water tank, and the plurality of valves are connected to each other and located inside of the recess part.

17. The refrigerator according to claim 16, further comprising:

a third insulation member located between the inner case and the outer case;

a dispenser tube guide pipe located at a side surface of the inner case and configured to guide the dispenser tube from a side surface of the recess part to the dispenser; and an ice maker tube guide pipe located at the side surface of the inner case and configured to guide the ice maker tube from the side surface of the recess part to the ice maker, wherein the dispenser tube guide pipe and the ice maker tube guide pipe are configured to be covered by the third insulation member between the inner case and the outer case.

18. The refrigerator according to claim 1, wherein the cabinet comprises a refrigerating compartment and a freezing compartment, wherein the evaporator is a roll bond evaporator located at the refrigerating compartment, and wherein the refrigerator further comprises a fin tube evaporator located at the freezing compartment.

19. The refrigerator according to claim 18, further comprising:

a first compressor that is configured to connect to the roll bond evaporator and that defines a first refrigeration cycle; and a second compressor that is configured to connect to the fin tube evaporator and that defines a second refrigeration cycle that is independent of the first refrigeration cycle.

20. The refrigerator according to claim 1, wherein the pair of side ducts are in contact with lateral ends of the first insulation member and the second insulation member and block lateral sides of the heat-exchange space, the heat-exchange space being defined between the first insulation member and the second insulation member in the forward-backward direction.

* * * * *